US009855774B2

(12) United States Patent
Seki et al.

(10) Patent No.: US 9,855,774 B2
(45) Date of Patent: Jan. 2, 2018

(54) RECORDING APPARATUS AND RECORDING METHOD

(71) Applicant: CANON KABUSHIKI KAISHA, Tokyo (JP)

(72) Inventors: Satoshi Seki, Kawasaki (JP); Kiichiro Takahashi, Yokohama (JP); Hirokazu Tanaka, Inagi (JP); Fumiko Suzuki, Kawasaki (JP); Gou Sasaki, Kawasaki (JP); Mayuko Yamagata, Inagi (JP); Tsukasa Doi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/226,797

(22) Filed: Aug. 2, 2016

(65) Prior Publication Data

US 2017/0036467 A1 Feb. 9, 2017

(30) Foreign Application Priority Data

Aug. 7, 2015 (JP) ..... 2015-157714

(51) Int. Cl.
*B41J 2/045* (2006.01)
*B41J 25/00* (2006.01)
(Continued)

(52) U.S. Cl.
CPC ..... *B41J 25/001* (2013.01); *B41J 2/04505* (2013.01); *B41J 2/04551* (2013.01);
(Continued)

(58) Field of Classification Search
CPC .... B41J 25/001; B41J 29/393; B41J 2/04505; B41J 2/04551; B41J 2/04573; B41J 2/2132
See application file for complete search history.

(56) References Cited

U.S. PATENT DOCUMENTS 6,364,447 B1 4/2002 Boleda
6,491,373 B1 12/2002 Fujita
(Continued)

FOREIGN PATENT DOCUMENTS

CN 101850657 A 10/2010
JP 7-81190 A 3/1995
(Continued)

*Primary Examiner* — Jason Uhlenhake
(74) *Attorney, Agent, or Firm* — Canon U.S.A., Inc. IP Division

(57) ABSTRACT

A recording apparatus includes a recording head including a plurality of recording elements arranged in a predetermined direction, and a determination unit configured to determine a first mode in which a specified image is recorded or a second mode in which a pattern is recorded in each of recording scannings in forward and backward directions to form an adjustment pattern for adjusting a recording position in the intersecting direction of the recording head, and the recording position of the recording head in accordance with the formed adjustment pattern is adjusted, in which a driving unit controls driving of the recording elements in a manner that a correspondence relationship between positions in the predetermined direction and the intersecting direction among a plurality of dots that form the same column is varied or is the same in the recording scannings in the forward and backward directions in accordance with the determined mode.

12 Claims, 36 Drawing Sheets

(51) Int. Cl.

| | |
|---|---|
| ***B41J 2/21*** | (2006.01) |
| ***B41J 19/14*** | (2006.01) |
| ***B41J 29/393*** | (2006.01) |

(52) U.S. Cl.

CPC ..... *B41J 2/04573* (2013.01); *B41J 2/2132* (2013.01); *B41J 19/145* (2013.01); *B41J 29/393* (2013.01)

(56) References Cited

U.S. PATENT DOCUMENTS

| | | | | |
|---|---|---|---|---|
| 7,517,038 | B2 | 4/2009 | Otsuki | |
| 8,836,992 | B2 | 9/2014 | Yorimoto | |
| 8,967,758 | B2 | 3/2015 | Hayashi | |
| 2003/0142153 | A1 | 7/2003 | Nakajima | |
| 2004/0223017 | A1* | 11/2004 | Otsuki | B41J 2/04505 347/14 |
| 2005/0052481 | A1 | 3/2005 | Takahashi | |
| 2012/0044287 | A1* | 2/2012 | Yamaguchi | B41J 2/2132 347/9 |

FOREIGN PATENT DOCUMENTS

| | | | |
|---|---|---|---|
| JP | 2013142809 | A | 7/2013 |
| JP | 2013159017 | A | 8/2013 |

* cited by examiner

FIG. 5

| | | NOZZLE COLUMN | |
|---|---|---|---|
| | | 2 pl | 5 pl |
| IMAGE SIGNAL VALUE C3 | 0 | 0 | × |
| | 1 | 1 | × |
| | 2 | 2 | × |

FIG. 6

| | | MASK VALUE | | |
|---|---|---|---|---|
| | | 0 | 1 | 2 |
| IMAGE SIGNAL VALUE C4 | 0 | NOT ARRANGED | NOT ARRANGED | NOT ARRANGED |
| | 1 | NOT ARRANGED | ARRANGED | NOT ARRANGED |
| | 2 | NOT ARRANGED | ARRANGED | ARRANGED |

FIG. 8A
| DRIVING ORDER | DRIVING BLOCK NO. |
|---|---|
| 1 | 1 |
| 2 | 9 |
| 3 | 6 |
| 4 | 14 |
| 5 | 3 |
| 6 | 11 |
| 7 | 8 |
| 8 | 16 |
| 9 | 5 |
| 10 | 13 |
| 11 | 2 |
| 12 | 10 |
| 13 | 7 |
| 14 | 15 |
| 15 | 4 |
| 16 | 12 |
FIG. 8B
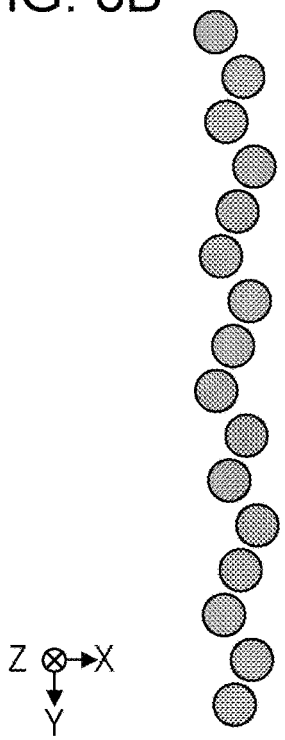
FIG. 8C
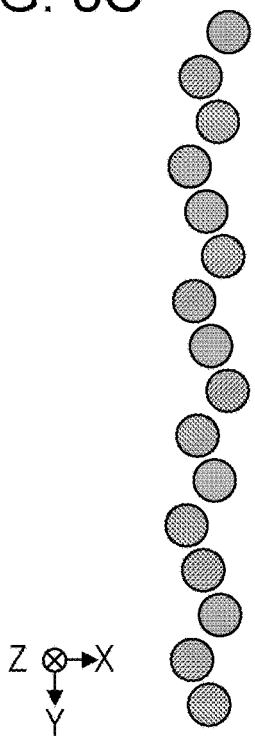

FIG. 12A
| DRIVING ORDER | DRIVING BLOCK NO. |
|---|---|
| 1 | 1 |
| 2 | 9 |
| 3 | 6 |
| 4 | 14 |
| 5 | 3 |
| 6 | 11 |
| 7 | 8 |
| 8 | 16 |
| 9 | 5 |
| 10 | 13 |
| 11 | 2 |
| 12 | 10 |
| 13 | 7 |
| 14 | 15 |
| 15 | 4 |
| 16 | 12 |
FIG. 12C
| DRIVING ORDER | DRIVING BLOCK NO. |
|---|---|
| 1 | 12 |
| 2 | 4 |
| 3 | 15 |
| 4 | 7 |
| 5 | 10 |
| 6 | 2 |
| 7 | 13 |
| 8 | 5 |
| 9 | 16 |
| 10 | 8 |
| 11 | 11 |
| 12 | 3 |
| 13 | 14 |
| 14 | 6 |
| 15 | 9 |
| 16 | 1 |
FIG. 12B
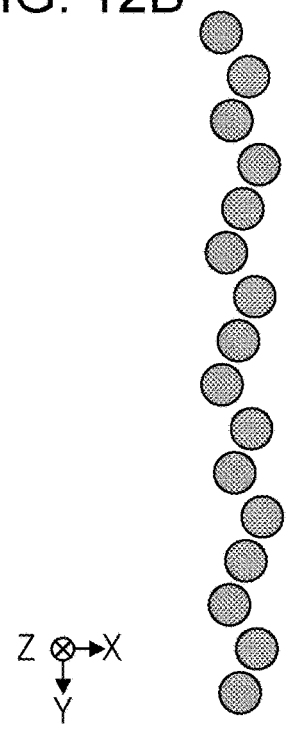
FIG. 12D
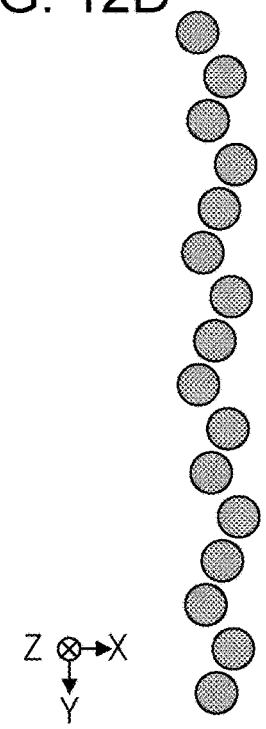

FIG. 25A
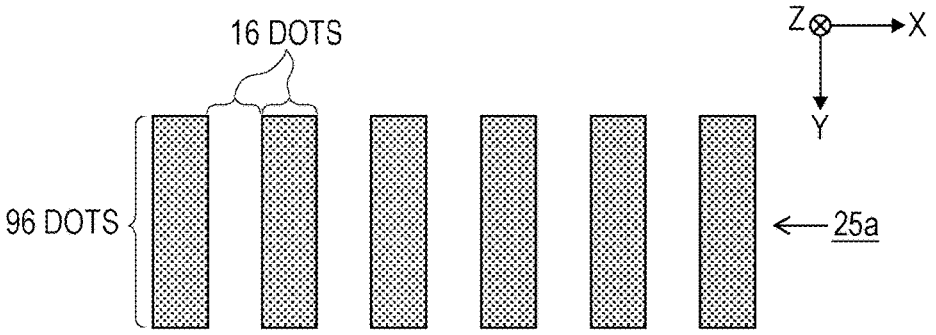
FIG. 25B
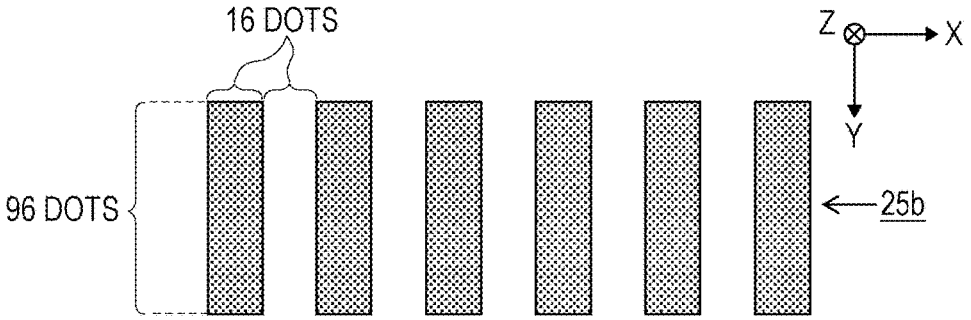
FIG. 25C
| TYPE OF REGISTRATION ADJUSTMENT | 2 pl FORWARD AND BACKWARD SCANNINGS | 5 pl FORWARD AND BACKWARD SCANNINGS | 2 pl−5 pl | ODD−EVEN | $\theta$ |
|---|---|---|---|---|---|
| REFERENCE PATTERN | 2 pl FORWARD DIRECTION | 5 pl FORWARD DIRECTION | 5 pl | EVEN | SHEET FEEDING SIDE NOZZLE |
| ADJUSTMENT PATTERN | 2 pl BACKWARD DIRECTION | 5 pl BACKWARD DIRECTION | 2 pl | ODD | SHEET DISCHARGING SIDE NOZZLE |

RECORDING APPARATUS AND RECORDING METHOD

BACKGROUND OF THE INVENTION

Field of the Invention

The present invention relates to a recording apparatus and a recording method.

Description of the Related Art

Among a number of inkjet recording apparatuses serial-type inkjet has become popular since costs are low and miniaturization can be realized. The serial-type inkjet recording apparatus includes a recording head provided with a plurality of nozzles and it performs recording by repeating a main scanning and a sub scanning.

With regard to the above-described recording apparatus, some recording apparatuses that can perform bidirectional recording by repeating a forward scanning and a backward scanning to carry out the recording have a function of adjusting ink application positions between the forward scanning and the backward scanning. Japanese Patent Laid-Open No. 7-81190 discloses a method of forming a plurality of adjustment patterns on a recording medium which are constituted by a combination of a pattern recorded in the forward scanning and a pattern recorded in the backward scanning by the recording apparatus. Adjusting relative ink application positions is performed between the forward scanning and the backward scanning. According to this method, shifting amounts in a scanning direction between the pattern based on the forward scanning and the pattern based on the backward scanning, which constitute the adjustment pattern, are mutually varied among the plurality of adjustment patterns to discriminate the adjustment pattern. Appropriate relative ink ejection timings between the forward scanning and the backward scanning are determined. This adjustment is preferably performed before the recording is executed by using the recording apparatus. When a user feels the need to perform the adjustment, it is possible to do so the adjustment by inputting an adjustment instruction through an interface.

On the other hand, in the serial-type inkjet recording apparatus, an uneven density may occur in an image in some cases depending on a variation of nozzle diameters and a variation of ejection directions. As a method of suppressing this uneven density, multi-pass recording is exemplified in which one area is complemented by a plurality of scannings to complete the recording. However, in a case where an unexpected recording position displacement between a certain scanning and another scanning among the plurality of scannings to complete the recording occurs in this multi-pass recording, an image having an uneven density may be formed. In particular, in the bidirectional recording, the displacement of the landing positions between the forward and backward scannings is likely to occur. A reason for this phenomenon includes that a distance between a recording head and a recording medium is unstable because of cockling of the recording medium or the like. When the displacement of the ink landing positions between the forward and backward scannings occurs, the image does not become uniform, and also, there is a concern that an uneven density may occur.

To address this issue, Japanese Patent Laid-Open No. 7-81190 proposed the following method of suppressing the occurrence of image non-uniformity that tends to appear when a recording position displacement between the scannings unexpectedly occurs in the multi-pass recording. First, in order to form the image by a plurality of recording scannings using the inkjet recording head with respect to the same recording area on the recording medium in the multi-pass recording, image data is divided into plural pieces corresponding to the respective scannings. A column of a plurality of recording elements is divided into a plurality of sections constituted by the plurality of recording elements each continuously arranged. The plurality of recording elements in each of the plurality of sections are divided into a plurality of blocks, and driving is performed in order by varying the driving timing for each block, which is so called time division driving. When recording is performed using both multi-pass recording and time division driving, control is performed to vary the block driving order of the time division driving corresponding to the respective scannings in the multi-pass recording.

However, even when the method described in Japanese Patent Laid-Open No. 7-81190 is adopted to record patterns based on forward scanning and backward scanning and attempt to adjust the recording position between the forward and backward scannings, it is found that it is difficult to perform accurate adjustment in some cases. According to Japanese Patent Laid-Open No. 7-81190, a test pattern is discriminated by using a state in which figures of the combination of patterns based on forward and backward scannings are different from each other in accordance with the displacement amounts of the mutual patterns based on the respective forward and backward scannings, and relative ink ejection timings between the scannings are determined. For this reason, if the figures of patterns are largely varied in a case where the recording position displacement between the forward and backward scannings occurs as compared with a case where no recording position displacement occurs, it is easier to discriminate the pattern. However, since the method according to Japanese Patent Laid-Open No. 7-81190 relates to a technology for suppressing the influence on the image even in a case where the displacement of the recording positions between the forward and backward scannings occurs, when the patterns for adjusting the recording positions are recorded by using this method, it is found out that it becomes rather more difficult to perform the adjustment.

SUMMARY OF THE INVENTION

The present invention is made in view of the above-described circumstances and aims at performing a more accurate adjustment in adjustment processing on recording positions in forward and backward scannings while a density fluctuation of an image caused by a displacement of the recording positions between the forward and backward scannings is suppressed when the image is recorded.

A recording apparatus according to an aspect of the present invention includes a recording head including a plurality of recording elements configured to eject ink which are arranged in a predetermined direction, the recording elements being arranged into a plurality of groups each of which is constituted by a plurality of predetermined adjacent recording elements, a scanning unit configured to execute a recording scanning in a forward direction and a recording scanning in a backward direction along an intersecting direction that intersects with the predetermined direction with respect to a unit area including a pixel area equivalent to a plurality of pixels on a recording medium by the recording head, a driving unit configured to drive each of the plurality of predetermined recording elements in order at different timings in the plurality of recording scannings, and a determination unit configured to determine a first mode in which an image specified by a user is recorded or a second mode in which a pattern is recorded in each of the recording scannings in the forward direction and the recording scannings in the backward direction by the scanning unit so as to form an adjustment pattern for adjusting a recording position in the intersecting direction of the recording head, and the recording position of the recording head in accordance with the formed adjustment pattern is adjusted, in which the driving unit is arranged to drive the plurality of recording elements in a manner that, in a case where the determination unit determines the first mode, a correspondence relationship between positions in the predetermined direction and positions in the intersecting direction among a plurality of dots that form the same column is varied in the recording scanning in the forward direction and the recording scanning in the backward direction, and in a case where the determination unit determines the second mode, the correspondence relationship between the positions in the predetermined direction and the positions in the intersecting direction among the plurality of dots that form the same column is the same in the recording scanning in the forward direction and the recording scanning in the backward direction.

Further features of the present invention will become apparent from the following description of exemplary embodiments with reference to the attached drawings. Embodiments of the embodiments of the present invention described below can be implemented solely or as a combination of a plurality of the embodiments or features thereof where necessary or where the combination of elements or features from individual embodiments in a single embodiment is beneficial.

BRIEF DESCRIPTION OF THE DRAWINGS

FIG. 5 illustrates a nozzle column development table according to the exemplary embodiment.

FIG. 6 illustrates a correspondence table of an image signal and a multi-value mask value according to the exemplary embodiment.

FIGS. 8A to 8C illustrate a time division driving order and an ink droplet arrangement in accordance with the time division driving order according to the exemplary embodiment.

FIGS. 12A to 12D are schematic diagrams of the time division driving order and the ink droplet arrangement in accordance with the time division driving order.

FIGS. 25A to 25C are schematic diagrams for describing a registration adjustment pattern and a registration adjustment item according to the exemplary embodiment.

DESCRIPTION OF THE EMBODIMENTS

Hereinafter, exemplary embodiments of the present invention will be described in detail with reference to the accompanying drawings.

Figure 1A:
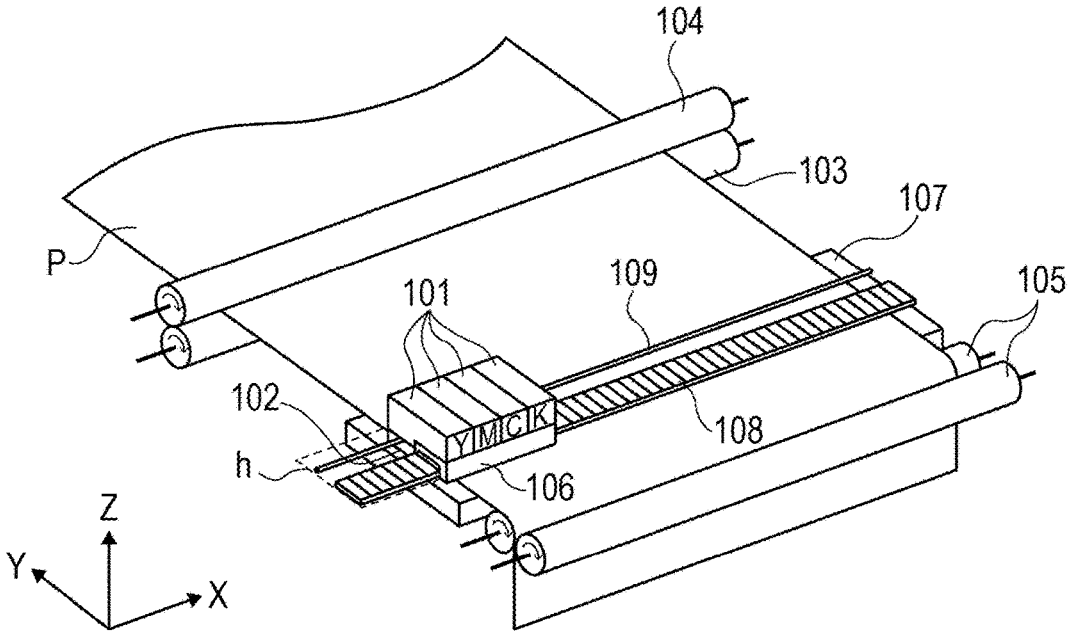
FIGS. 1A and 1B are perspective views illustrating an internal configuration of a recording apparatus according to an exemplary embodiment.
Figure 1B:
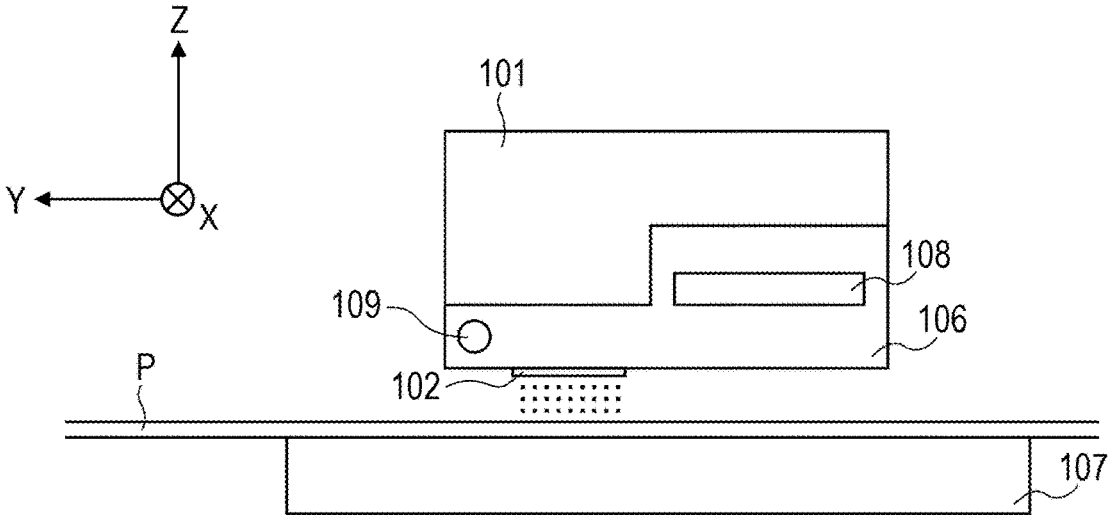

FIGS. 1A and 1B are schematic diagrams of a recording apparatus according to an exemplary embodiment of the present invention. FIG. 1A is a perspective view of the recording apparatus, and FIG. 1B is a cross sectional view in a case where a recording head is cut in parallel to a Y axis and a Z axis in FIG. 1A. FIGS. 1A and 1B illustrate ink cartridges 101. According to the present configuration, four cartridges are mounted and respectively contain ink of cyan (C), magenta (M), yellow (Y), and black (K). A recording head 102 ejects the above-described ink to be landed on a facing recording medium P. A conveyance roller 103 and an auxiliary roller 104 operate in cooperation to rotate in an arrow direction in the drawing while nipping the recording medium P and convey the white recording medium P in a +Y direction as needed. A sheet feeding roller 105 supplies the recording medium P and also serves a role of nipping the recording medium P similarly as in the conveyance roller 103 and the auxiliary roller 104. A carriage 106 supports the ink cartridges 101 and moves these cartridges when recording is performed. When the recording is not performed or a recovery operation of the recording head or the like is performed, the carriage 106 stands by at a home position h corresponding to a position indicated by a dotted line in FIG. 1A. A platen 107 serves a role of stably supporting the recording medium P at a recording position. With a carriage belt 108, the carriage 106 is scanned in an X direction, and a carriage shaft 109 supports the carriage 106. The present recording apparatus forms an image by alternately repeating the recording scanning based on carriage scanning in ±X directions and the conveyance of the recording medium in the +Y direction. The direction of this scanning is an intersecting direction that intersects with a nozzle array direction which will be described below. Herein, a displacement in the X direction ideally does not exist between a certain scanning and the next scanning, but the displacement in the X direction may unexpectedly occur in some cases depending on the scanning accuracy of the carriage 106 or the conveyance accuracy of the conveyance roller 103 and the auxiliary roller 104.

Figure 29:
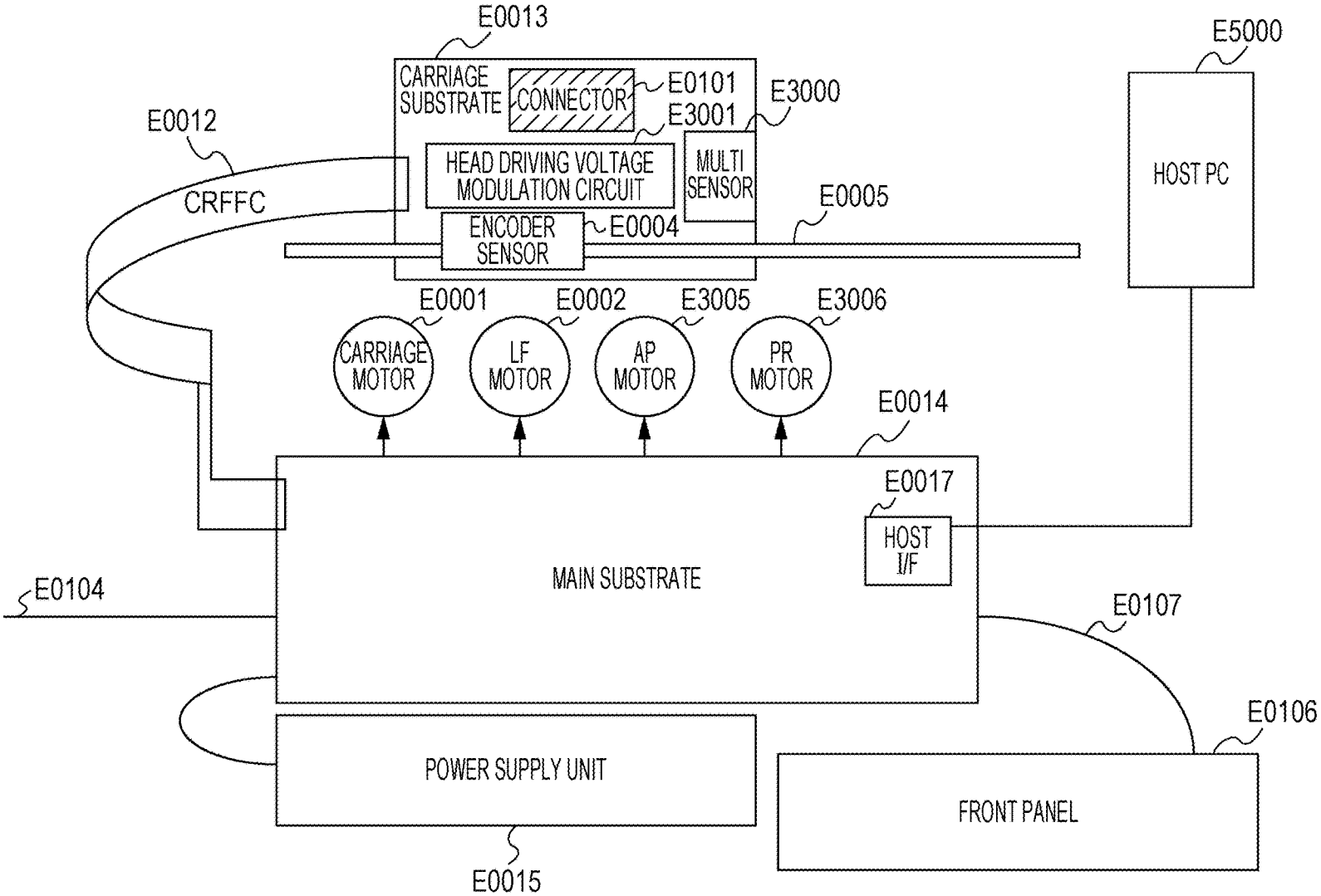
FIG. 29 is a schematic diagram illustrating the electric circuit configuration of the recording apparatus according to the exemplary embodiment.

FIG. 29 is a block diagram for schematically describing a configuration of an electric circuit of the recording apparatus according to the exemplary embodiment. The recording apparatus according to the exemplary embodiment includes a carriage substrate E0013, a main substrate E0014, a power supply unit E0015, and a front panel E0106. The power supply unit E0015 is connected to the main substrate E0014 and supplies various driving power supplies. The carriage substrate E0013 is a printed-circuit board unit mounted to a carriage M4000 and performs exchange of signals with the recording head 102 through a head connector E0101 or head driving power supply via a flexible flat cable (CRFFC) E0012. In addition, the carriage substrate E0013 detects a change in a positional relationship between an encoder scale E0005 and an encoder sensor E0004 on the basis of a pulse signal output from the encoder sensor E0004 along with the movement of the carriage 106. Subsequently, the carriage substrate E0013 further outputs the output signal to the main substrate E0014 via the flexible flat cable (CRFFC) E0012. The main substrate E0014 is a printed-circuit board unit that governs driving controls of the respective units of the recording apparatus. The main substrate E0014 includes a host interface E0017 on its substrate and performs control of a recording operation on the basis of reception data from a host computer (host PC) E5000. In addition, the main substrate E0014 is connected to various motors including a carriage motor E0001 functioning as a driving source for causing the carriage M4000 to perform main scanning and an LF motor E0002 functioning as a driving source for conveying the recording medium and controls drivings of the respective functions. Furthermore, the main substrate E0014 is connected to a sensor signal E0104 configured to perform transmission and reception of control signals and detection signals with respect to various sensors such as an LF encoder sensor configured to detect operational statuses of the respective units of the printer. In addition, the main substrate E0014 is connected to both the CRFFC E0012 and the power supply unit E0015 and can further perform exchange of information with the front panel E0106 via a panel signal E0107. The front panel E0106 is a panel for a user to input various instructions such as a touch panel.

Figure 24:
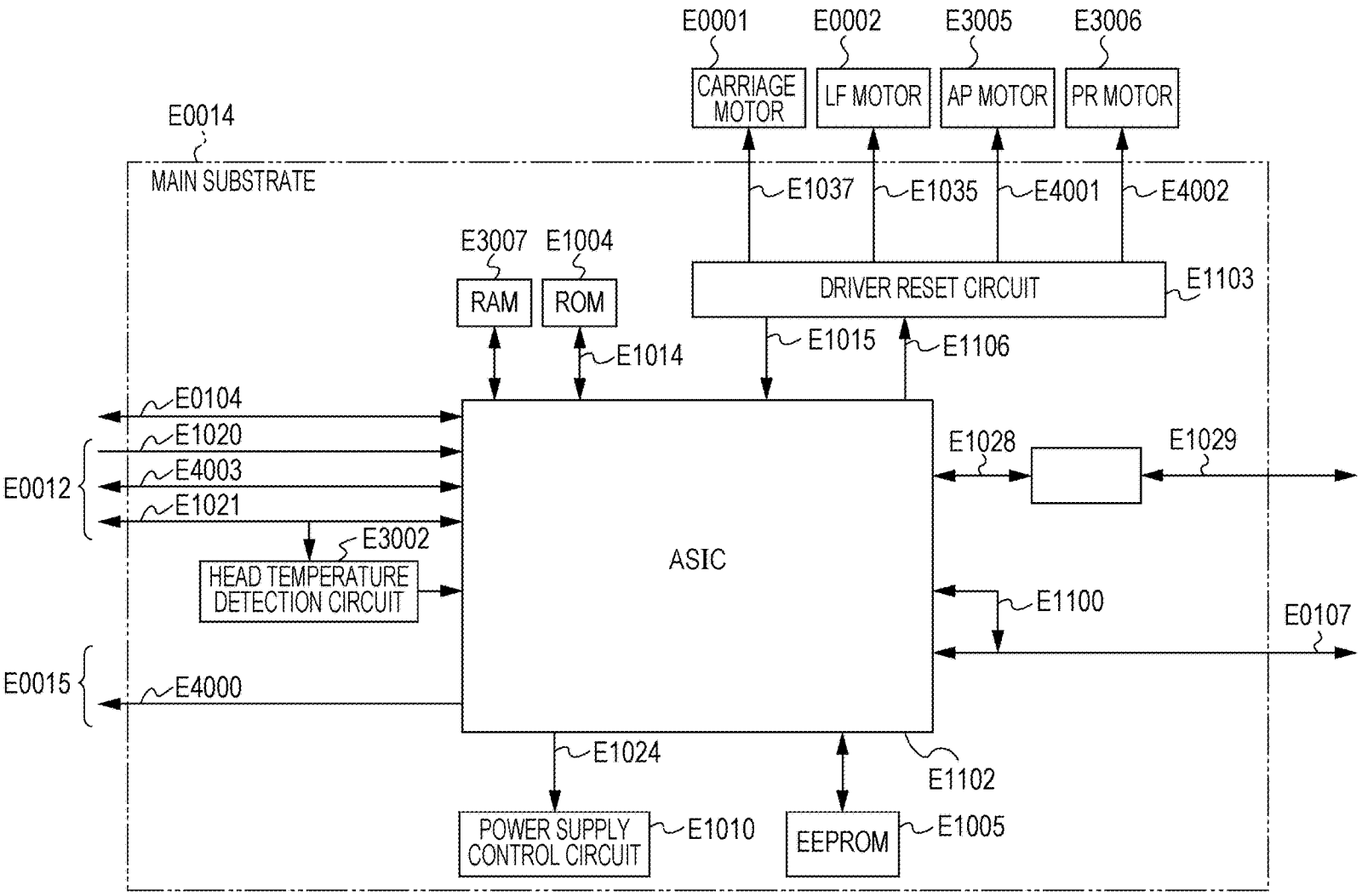
FIG. 24 is a schematic diagram illustrating an electric circuit configuration of the recording apparatus according to the exemplary embodiment.

FIG. 24 is a block diagram illustrating an internal configuration of the main substrate E0014 of the recording apparatus according to the exemplary embodiment. In the drawing, an ASIC E1102 is connected to a ROM E1004 through a control bus E1014 and performs various controls in accordance with a program stored in the ROM E1004. For example, the ASIC E1102 performs transmission and reception of the sensor signal E0104 associated with various sensors and also detects a state of an encoder signal E1020 or the like. In addition, the ASIC E1102 performs various logical operations, condition determination, and the like in accordance with a connection of a host interface E0017 and a data input state to control various constituent elements and governs the control of the recording apparatus. A power supply control circuit E1010 controls power supply to each sensor or the like including a light emitting element in accordance with a power supply control signal E1024 from the ASIC E1102. The host interface E0017 transmits a host interface signal E1028 from the ASIC E1102 to the host interface cable E1029 connected to an external part and transmits a signal from the host interface cable E1029 to the ASIC E1102. On the other hand, the power is supplied from the power supply unit E0015. The supplied power is converted into a voltage to be supplied to the respective units inside and outside the main substrate E0014 as necessary. In addition, a power supply unit control signal E4000 from the ASIC E1102 is connected to the power supply unit E0015 to control a low power consumption mode of the recording apparatus or the like. The ASIC E1102 is a one-chip semiconductor integrated circuit built in a calculation processing apparatus and outputs a motor control signal E1106, the power supply control signal E1024, the power supply unit control signal E4000, and the like. The ASIC E1102 then performs exchange of signals with the host interface E0017 and controls constituent elements such as various sensors via the sensor signal E0104 and also detects states thereof. Furthermore, the ASIC E1102 generates a timing signal by detecting a state of the encoder signal (ENC) E1020 and controls a recording operation of a recording head H1001 on the basis of a head control signal E1021. The encoder signal (ENC) E1020 mentioned herein is an output signal of the encoder sensor E0004 input through the CRFFC E0012. The head control signal E1021 is connected to the carriage substrate E0013 through the flexible flat cable E0012 to be supplied to the recording head H1001 via the head connector E0101. In addition, various pieces of information from the recording head H1001 are transmitted to the ASIC E1102. In the drawing, a RAM E3007 is used as a data buffer for recording, a buffer for data received from the host computer, and the like and is also used as a work area used for various control operations. An EEPROM E1005 is used for storing various information such as recording history and calling out the information as necessary. While the head control signal E1021 is monitored, a dot ejection signal to the recording head is counted for each ejection opening, and a numeric value obtained as an accumulation thereof is stored in the EEPROM E1005 as the recording history, so that it is possible to switch the control by calling out the value as necessary.

Figure 2A:
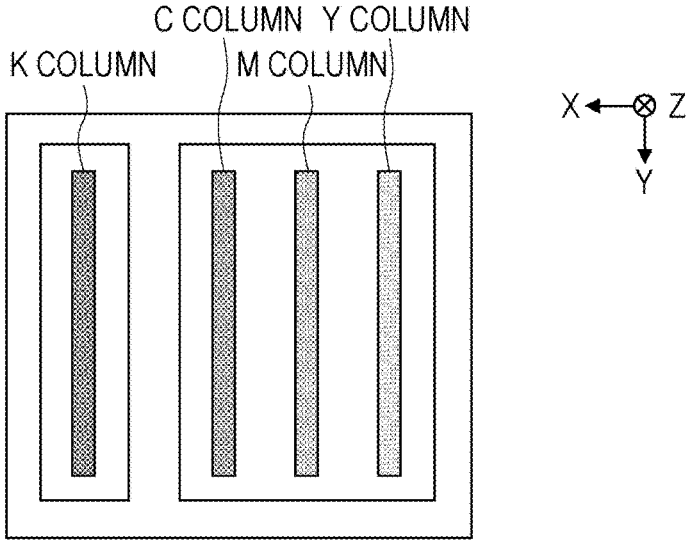
FIGS. 2A to 2C are schematic diagrams of a recording head according to the exemplary embodiment.
Figure 2B:
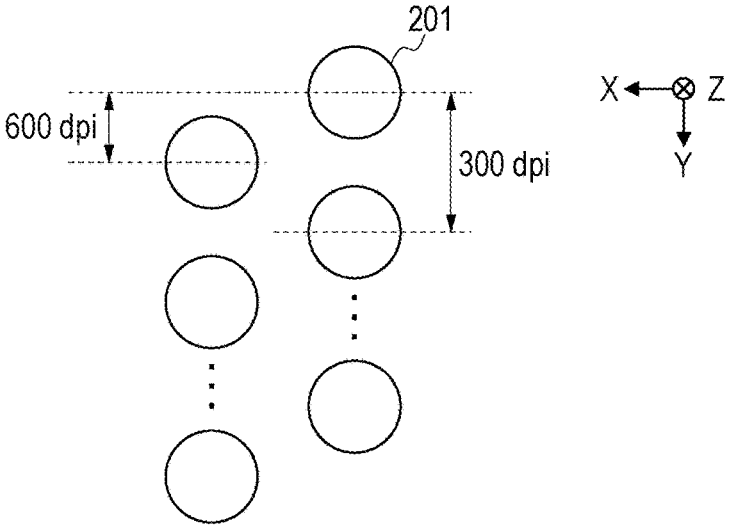
Figure 2C:
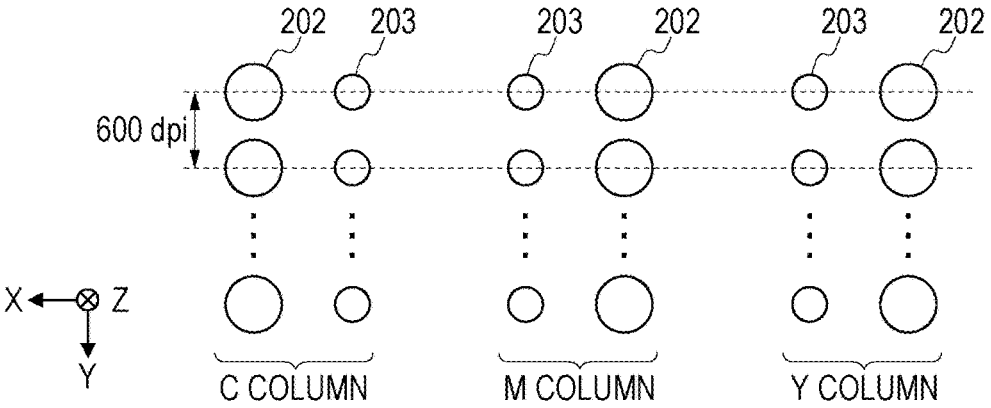

FIGS. 2A to 2C illustrate a configuration of the recording head. FIG. 2A is a plan view as the recording head is seen in a Z direction, FIG. 2B is an expanded view of an area around a nozzle of a K column, and FIG. 2C is an expanded view of an area around nozzles of a C column, an M column, and a Y column. In FIG. 2A, black ink is ejected from the K column, cyan ink is ejected from the C column, magenta ink is ejected from the M column, and yellow ink is ejected from the Y column. Separate semiconductor chips are used for the K column and for the other columns including the C column, the M column, and the Y column. FIG. 2B is the expanded view of the K column. The K column is constituted by nozzles 201 that eject the ink amount of 25 pl and forms a dot having a diameter of approximately 60 um when landed on the recording medium. With regard to an intra-column direction (Y direction) corresponding to a predetermined direction, two nozzle columns arranged at an interval of 300 dpi are arranged while being shifted in the intra-column direction (Y direction) by 600 dpi. A left side in the drawing corresponds to an odd column, and a right side corresponds to an even column. Heaters corresponding to recording elements (not illustrated) are arranged immediately below the respective nozzles (+Z direction). When the heater is heated, the ink immediately above generates foaming, and the ink is accordingly ejected from the nozzle. In FIG. 2B, only three nozzles are illustrated in the respective columns in the intra-column direction (Y direction), but in actuality, 64 nozzles are arranged in the respective columns. FIG. 2C is an expanded view of the C column, the M column, and the Y column. Each of the C column, the M column, and the Y column is constituted by nozzles 202 that eject the ink amount of 5 pl and nozzles 203 that eject the ink amount of 2 pl. With the ink amount of 5 pl, a dot having a diameter of approximately 50 um is formed when landed on the recording medium, and with the ink amount of 2 pl, a dot having a diameter of approximately 35 um is formed when landed on the recording medium. With regard to the intra-column direction (Y direction), 5 pl nozzle columns and 2 pl nozzle columns and are both arranged at an interval of 600 dpi. Heaters corresponding to recording elements (not illustrated) are arranged immediately below the respective nozzles (+Z direction). When the heater is heated, the ink immediately above generates foaming, and the ink is accordingly ejected from the nozzle. In FIG. 2C, only three nozzles are illustrated in the respective columns in the intra-column direction (Y direction), but in actuality, 128 nozzles are arranged in the respective columns.

To eject the ink at the same timing by driving all the ejection openings at the same time in the recording apparatus using the recording head where a large number of ejection openings are arranged in the above-described manner, a large-capacity power supply is needed. For this reason, a method of performing the time division driving is adopted for sequentially driving the heaters corresponding to a predetermined number of ejection openings arranged in the recording head within a period of a driving cycle. Specifically, all the ejection openings of the recording head are divided into several groups, and timings for driving the heaters corresponding to each of the groups are gradually changed. When this time division driving is performed, the number of ejection openings driven at the same time is decreased, so that it is possible to suppress the capacity of the power supply used in the recording apparatus.

Figure 28:
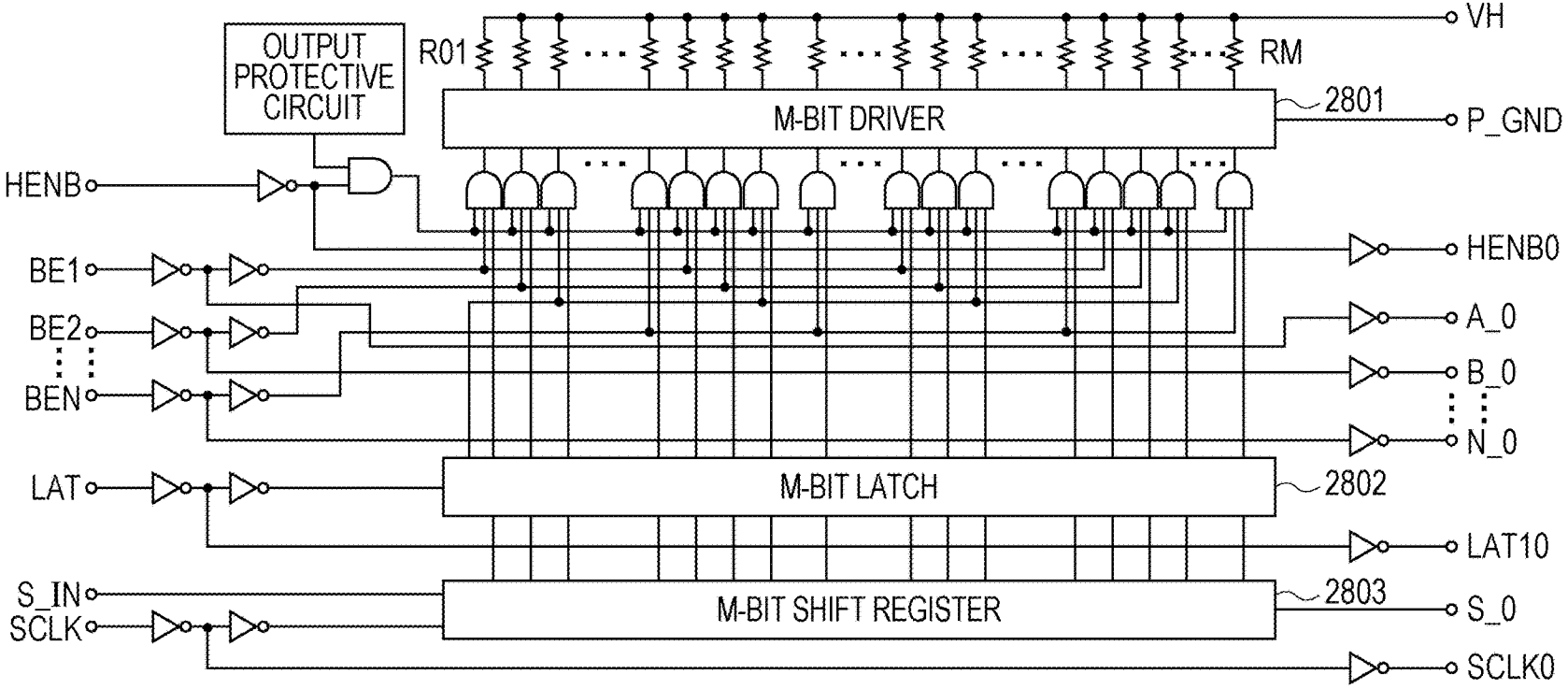
FIG. 28 is a schematic diagram illustrating a driving circuit configuration of the recording head according to the exemplary embodiment.

FIG. 28 is a block diagram illustrating a general configuration of a driving circuit for the recording head using the time division driving method. In FIG. 28, one ends of M pieces of respective heaters R01 to RM are commonly connected to a driving voltage VH, and the other ends are connected to an M-bit driver 2801. A logical product (AND) signal of an output signal from an M-bit latch 2802 and an N-bit block enable selection signal (BE1 to BEN) is input to the M-bit driver 2801. An M-bit signal output from an M-bit shift register 2803 is connected to the M-bit latch 2802, and when a latch signal (LAT) is supplied, the M-bit latch 2802 latches (records and holds) M-bit data stored in the M-bit shift register 2803. The M-bit shift register 2803 is a circuit for alignment storage of the image data in response to the recording signal. The image data transmitted via a signal line S_IN is input to the M-bit shift register 2803 in synchronization with an image data transfer clock (SCLK). In the thus constituted driving circuit, temporally divided driving signals are sequentially input as the block enable selection signals (BE1 to BEN), and N pieces of heaters are driven for each block in a time division manner. That is, the plurality of heaters included in the recording head are divided into a plurality of blocks and driven in the time division manner, and the recording is carried out.

Herein, control of the block enable selection signals will be described. The block enable selection signal is controlled by the ASIC E1102 in the main substrate E0014 illustrated in FIG. 24. The block enable selection signal is generated by a head control circuit previously incorporated in the ASIC E1102 and transmitted to the recording head H1001 as the head control signal E1021. The RAM E3007, the ROM E1004, or a storage area of the ASIC holds a block order setting table for setting a block driving order. The block enable selection signal is appropriately generated on the basis of this block driving order setting table. That is, a configuration is adopted in which a control signal of the recording head is generated by a control circuit included in the recording apparatus on the main substrate and transmitted to the recording head. The block order setting table sets plural ways of driving orders that are different with respect to the same heater column, and these plural driving orders can be appropriately used in accordance with a mode executed by the recording apparatus or a direction of the scanning at the time of the recording.

Depending on the recording apparatus, a configuration can also be adopted in which the head control circuit is provided to a control substrate inside the recording head or the like, and only the image signal is transmitted to the recording head, but this configuration only simply separates the functions, and the substantive flow of the control signal is the same.

Figure 3A:
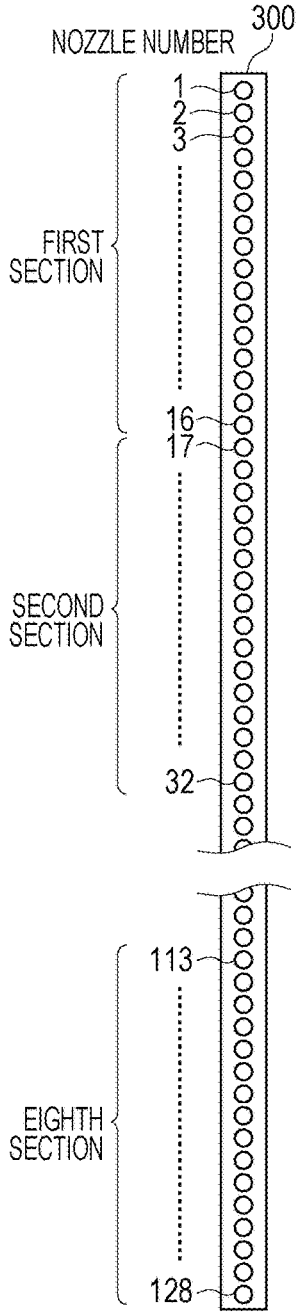
FIGS. 3A to 3C are explanatory diagrams for describing driving of the recording head according to the exemplary embodiment.
Figure 3B:
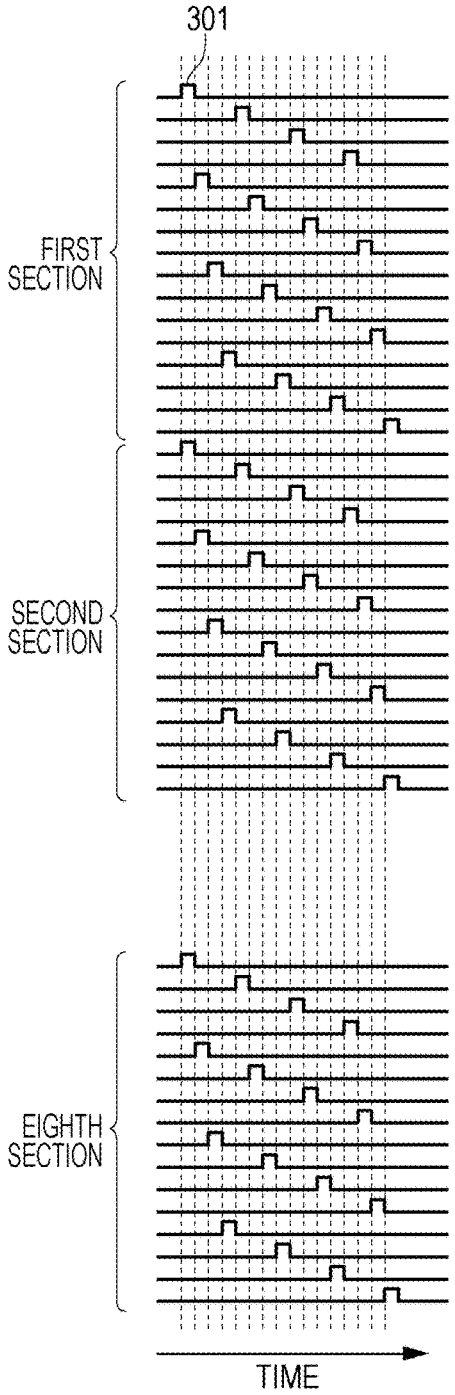
Figure 3C:
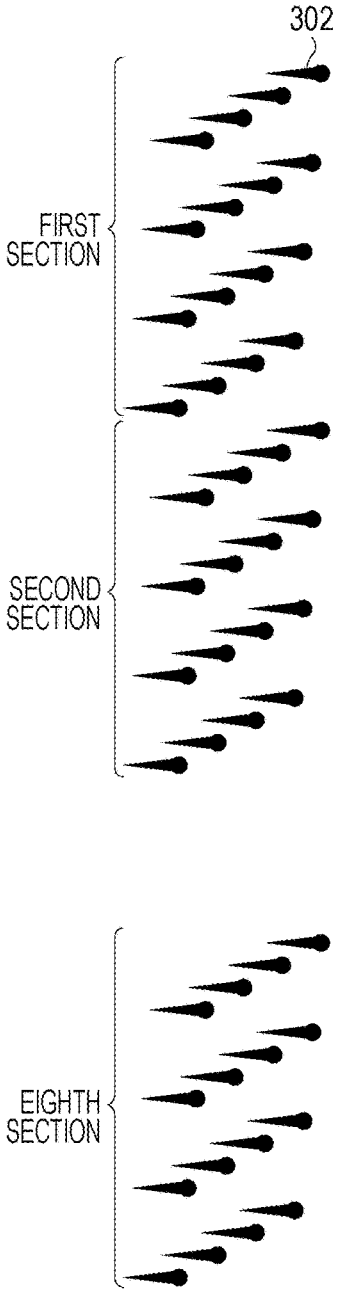

FIG. 3A schematically illustrates a nozzle column of the recording head, FIG. 3B schematically illustrates driving signals applied to the respective nozzles, and FIG. 3C schematically illustrates ink droplets ejected from the respective nozzles. In FIG. 3A, a nozzle column 300 of the inkjet recording head is constituted by 128 nozzles, and these nozzles are divided in units of 16 nozzles into eight sections (groups) from a first section to an eighth section from the top of FIG. 3A. Furthermore, respective 16 nozzles in the respective sections belong to one of 16 driving blocks and are temporally divided in units of block and sequentially driven at the time of the recording. In the time division driving, the nozzles in the same block are driven at the same time. According to the illustrated example, 16 nozzles having nozzle numbers 1, 17, . . . , 113 in the nozzle column 300 belong to a first driving block (driving block No. 1), and 16 nozzles having nozzle numbers 2, 18, . . . , 114 belong to a second driving block (driving block No. 2). Similarly, 16 nozzles having nozzle numbers 16, 32, . . . , 128 belong to a sixteenth driving block (driving block No. 16), and the nozzles in the respective sections are periodically allocated to the respective driving blocks. In the case of the time division driving where the driving blocks Nos. 1, 5, 9, 13, 2, 6, 10, 14, 3, 7, 11, 15, 4, 8, 12, and 16 are driven in the stated order, the respective heaters are sequentially driven by pulsed driving signals 301 illustrated in FIG. 3B. In a case where the recording data of the one column is data for turning the 128 nozzles ON, ink droplets 302 are ejected from the respective nozzles in response to the driving signals as illustrated in FIG. 3C. Accordingly, the ink droplets based on the recording data of the same column are ejected in the time division manner. In the next cycle, the ink droplets based on the recording data of the next column can be similarly ejected in the time division manner.

Figure 4:
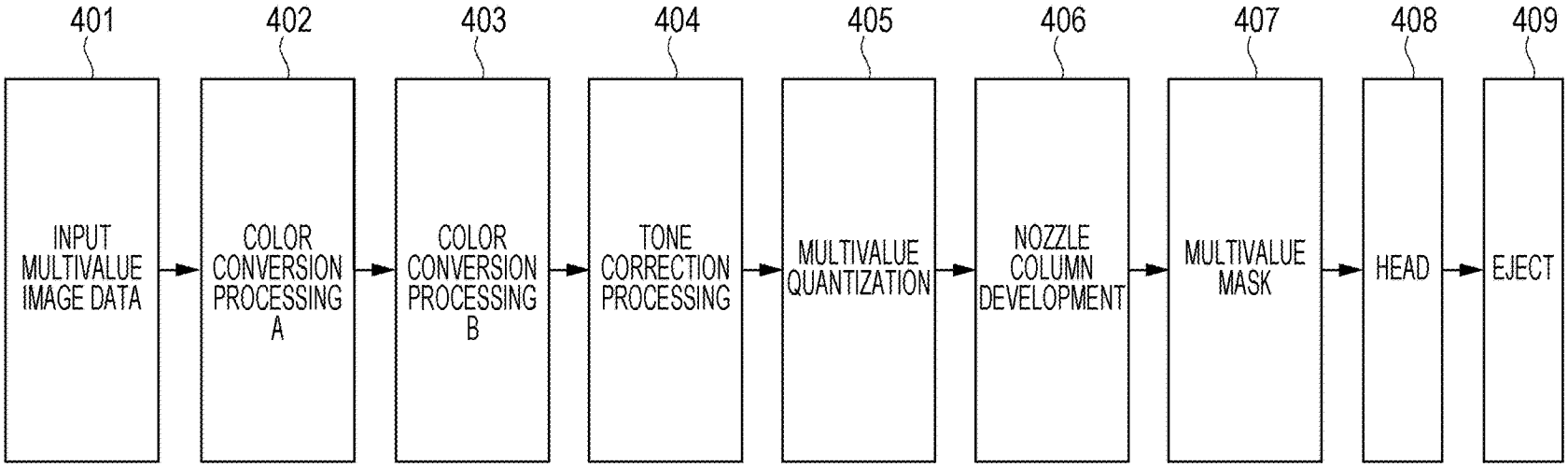
FIG. 4 is a flow chart for creating recording data according to the exemplary embodiment.
Figure 7A:
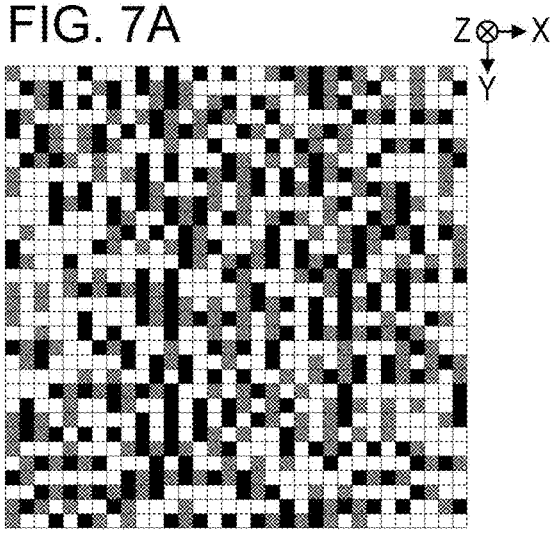
FIGS. 7A to 7F are schematic diagrams of a mask pattern according to the exemplary embodiment.
Figure 7B:
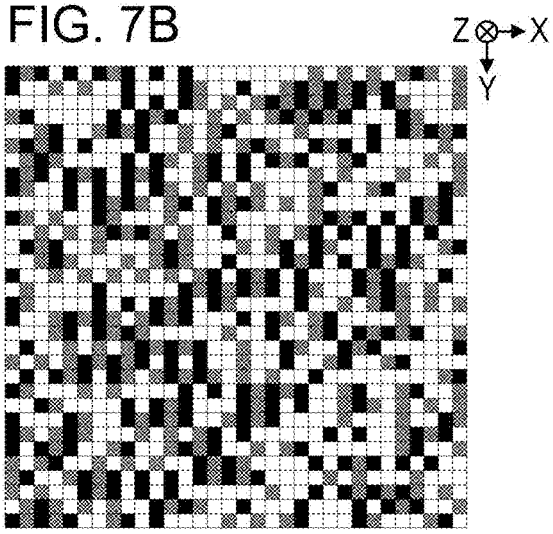
Figure 7C:
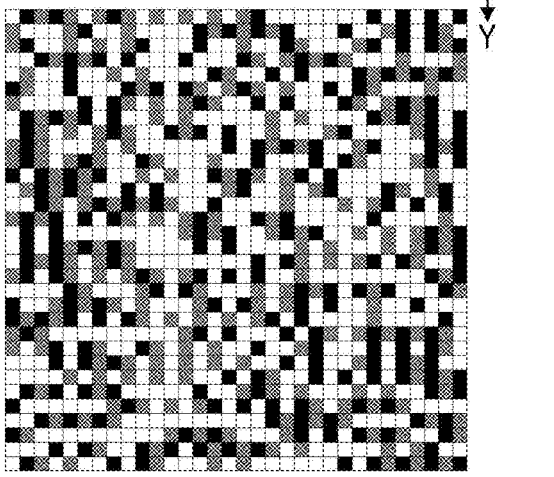
Figure 7D:
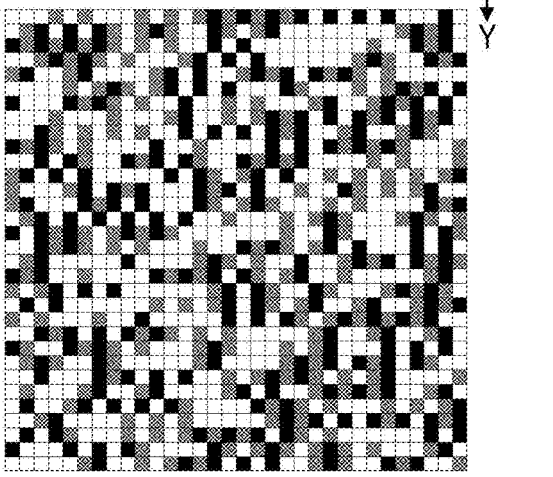
Figure 7E:
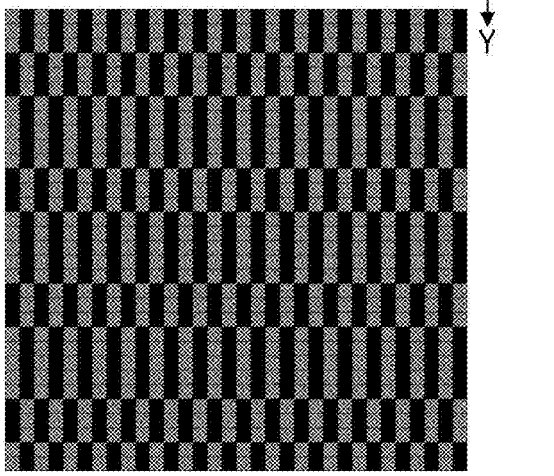
Figure 7F:
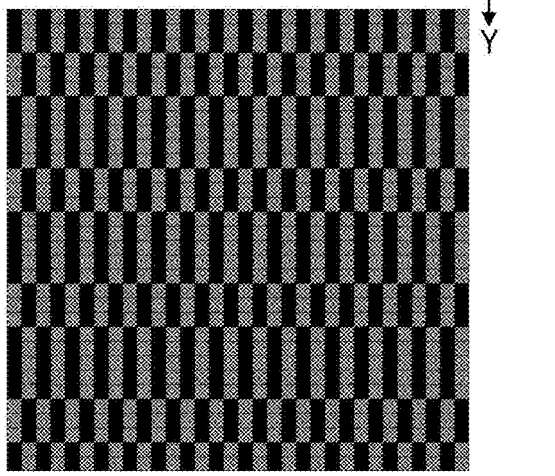

With regard to the processing of completing the same area by plural scannings on the basis of the multi-pass method to perform the recording of the desired image specified by the user, FIG. 4 is a flow chart for describing the processing of completing the same area by four scannings. In step 401, an original image signal having respective 256 tones (0 to 255) for RGB obtained by an image input device such as a digital camera or a scanner or obtained computer processing or the like is input to a printer driver of the host PC E5000 at a resolution of 600 dpi. In color conversion processing A in step 402, the RGB original image signal input in step 401 is converted into an R'G'B' signal. In color conversion processing B in the next step 403, the R'G'B' signal is converted into signal values corresponding to the respective colors of ink. The recording apparatus according to the exemplary embodiment is constituted by three colors including C (cyan), M (magenta), and Y (yellow). Therefore, signals after the conversion are image signals C1, M1, and Y1 corresponding to the ink colors of cyan, magenta, and yellow. The numbers of tones of the respective image signals C1, M1, and Y1 are 256 (0 to 255), and the resolution is 600 dpi. It should be noted that, according to the specific color conversion processing B, a three-dimensional look-up table (not illustrated) that represents relationships between the respective input values of R, G, and B and the respective output values of C, M, and Y is used, and with regard to an input value out of a table grid point value, an output value is obtained through an interpolation from its surrounding table grid point output value. Hereinafter, the image signal C1 will be described as a representative example. In step 404, tone of the image signal C1 is corrected through tone correction using a tone correction table, an image signal C2 after the tone correction is obtained. In step 405, multi-value quantization processing based on an error diffusion method is performed to obtain an image signal C3 having a resolution of 600 dpi with three tones (0, 1, and 2) with regard to each pixel. Herein, the error diffusion method is used, but a dither method may also be used. The obtained image signal C3 is transmitted to the recording apparatus. In the next step 406, the image signal C3 is subjected to a nozzle column development table illustrated in FIG. 5 to obtain an image signal C4 in each nozzle column. According to the present exemplary embodiment, as illustrated in FIG. 5, the image signal C4 in the 5-pl nozzle column is not generated, and the image signal C4 in the 2-pl nozzle column is rasterized into the three tones "0", "1", and "2". In step 407, multi-value mask processing is performed, and the image signal C4 is collated with a multi-value mask to obtain an image signal C5 that determines whether or not the ink droplet is arranged in the pixel area equivalent to the pixel on the sheet. A resolution of the multi-value mask is 600 dpi and has mask values corresponding to three values (0, 1, and 2). As illustrated in FIG. 6, the ink droplets are not arranged in response to the signal value "0" of the image signal C4 in a case where the mask value is any of the value. The ink droplets are arranged in response to the signal value "1" of the image signal C3 only in a case where the mask value is 1. The ink droplets are arranged in response to the signal value "2" of the image signal C3 in a case where the mask value is "1" or "2". In other words, the mask value "1" permits maximum two ink ejections with respect to the pixel area, and the mask value "2" permits maximum one ink ejection with respect to the pixel area. The multi-value mask used in the present exemplary embodiment is constituted by four multi-value masks MP1, MP2, MP3, and MP4 having a width of 32 in the Y direction and a width of 32 in the X direction. FIGS. 7A to 7F illustrate the multi-value mask patterns. FIG. 7A illustrates MP1, FIG. 7B illustrates MP2, FIG. 7C illustrates MP3, and FIG. 7D illustrates MP4, in which a white part represents the mask value "0", a hatched part represents the mask value "1", and a black part represents the mask value "2". As a feature of the multi-value mask pattern, an arrangement in which each of the mask values "1" and "2" complements when the four multi-value masks MP1 to MP4 are overlapped with one another is obtained. Accordingly, the ink droplet is to be arranged once in any of the four multi-value masks MP1 to MP4 with respect to the signal value "1" of the image signal C4, and the ink droplet is to be arranged twice in any of the four multi-value masks MP1 to MP4 with respect to the signal value "2" of the image signal C4. In addition, as another feature of the multi-value mask pattern, when MP1 and MP3 among the four multi-value masks are added to each other, a vertically long houndstooth check in which the mask values "1" and "2" are mutually periodic is obtained (FIG. 7E). The multi-value mask used herein is a pattern in which houndstooth checks having lengths of 3×3×2 in the Y direction and a length of 1 in the X direction are repeated. Similarly, when MP2 and MP4 are added to each other, a houndstooth check in which the mask values "1" and "2" are inverted with respect to the above-described arrangement is obtained (FIG. 7F). In step 408, the image signal C5 is transmitted to the head. In step 409, the ink is ejected to the pixel area equivalent to the pixels on the recording medium on the basis of the image signal C5. At this time, the heaters are driven on the basis of the time division driving to eject the ink to carry out the recording.

FIGS. 8A to 8C illustrate a relationship between the heater driving order and the arrangement of the ink droplets on the sheet based on the above-described driving order. FIG. 8A is a table indicating the heater driving order used in the present exemplary embodiment. First, the nozzles of the driving block No. 1 in the respective nozzle sections eject the ink (nozzle numbers 1, 17, . . . , 113). Second, the nozzles of the driving block No. 9 in the respective nozzle sections eject the ink (nozzle numbers 9, 25, . . . , 118). Hereinafter, the driving block No. 6 in the third place and the driving block No. 14 in the third place follow. Until the nozzles of the driving block No. 12 eject the ink in the sixteenth place, the ink is ejected within a scanning width of 600 dpi. When a case is supposed where the ink is ejected in the above-described driving order during the scanning in the +X direction (forward direction) in response to the image signal C5 for one pixel in the horizontal direction and 16 pixels in the vertical direction, the arrangement of the ink droplets on the sheet corresponds to the arrangement illustrated in FIG. 8B. On the other hand, when a case is supposed where the ink is ejected in the above-described driving order during the scanning in the −X direction (backward direction) in response to the same image signal C5 as the above, the arrangement of the ink droplets on the sheet corresponds to the arrangement illustrated in FIG. 8C. This is the arrangement obtained through the mirror inversion with respect to FIG. 8B in the X direction. That is, FIG. 8C has the order reverse to that of FIG. 8B.

Figure 9:
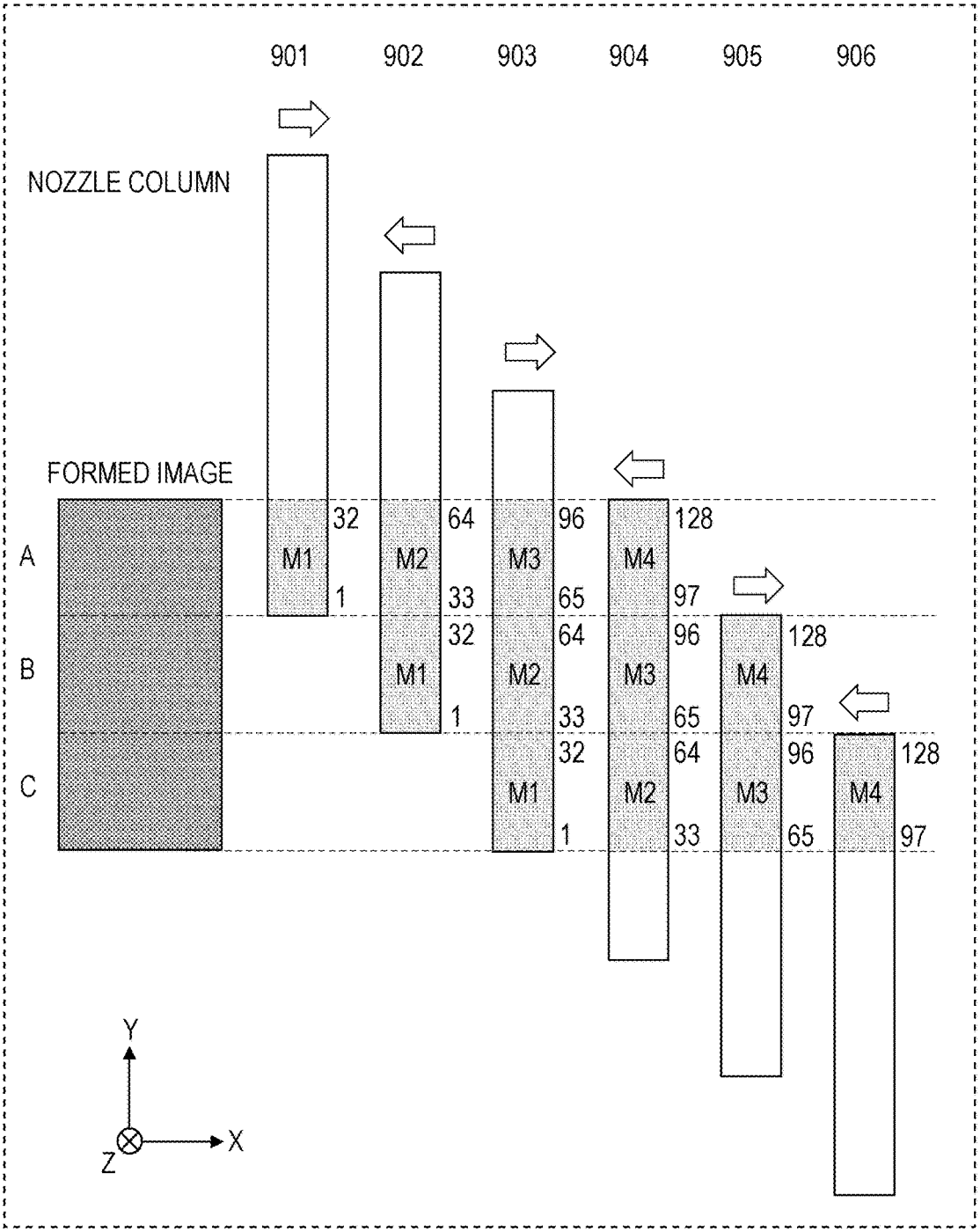
FIG. 9 is a schematic diagram for describing a multi-pass recording operation according to the exemplary embodiment.

FIG. 9 is a schematic diagram illustrating a relationship between the recording medium conveyance and the nozzles to be used when the image is formed. Herein, the C column is used for the descriptions as the nozzle column, but the M column and the Y column also have the same relationship. In a case where the formed image is larger than 32 pixels in the scanning direction, the multi-value masks MP1 to MP4 are repeatedly used in the X direction. In step 901, the nozzle numbers 1 to 32 are used, and the scanning is performed in the +X direction (forward direction) to carry out the recording. The recording data at this time is the image signal C5 obtained by collating the multi-value mask MP1 with the image signal C4 corresponding to a formed image area A (M1 in the drawing). The arrangement of the ink droplets on the sheet in accordance with the time division driving corresponds to the arrangement illustrated in FIG. 8B. After the scanning, the recording medium P is conveyed by 32 in units of 600 dpi in the +Y direction. For convenience, FIG. 9 illustrates a relative positional relationship between the nozzles and the recording medium by moving the nozzles in the −Y direction. In step 902, the nozzle numbers 1 to 64 are used, and the scanning is performed in the −X direction (backward direction) to carry out the recording. The recording data at this time is the image signal C5 obtained by collating the multi-value mask MP1 with the image signal C4 corresponding to a formed image area B with regard to the nozzle numbers 1 to 32. The recording data at this time is the image signal C5 obtained by collating the multi-value mask MP2 with the image signal C4 corresponding to the formed image area A with regard to the nozzle numbers 33 to 64 (M2 in the drawing). The arrangement of the ink droplets on the sheet in accordance with the time division driving corresponds to the arrangement illustrated in FIG. 8C. After the scanning, the recording medium P is conveyed by 32 in units of 600 dpi in the +Y direction. In step 903, the nozzle numbers 1 to 96 are used, and the scanning is performed in the +X direction (forward direction) to carry out the recording. The recording data at this time is the image signal C5 obtained by collating the multi-value mask MP1 with the image signal C4 corresponding to a formed image area C with regard to the nozzle numbers 1 to 32. The recording data at this time is the image signal C5 obtained by collating the multi-value mask MP2 with the image signal C4 corresponding to the formed image area B with regard to the nozzle numbers 33 to 64. The recording data at this time is the image signal C5 obtained by collating the multi-value mask MP3 with the image signal C4 corresponding to the formed image area A with regard to the nozzle numbers 65 to 96 (M3 in the drawing). The arrangement of the ink droplets on the sheet in accordance with the time division driving corresponds to the arrangement illustrated in FIG. 8B. After the scanning, the recording medium P is conveyed by 32 in units of 600 dpi in the +Y direction. In step 904, the nozzle numbers 33 to 128 are used, and the scanning is performed in the −X direction (backward direction) to carry out the recording. The recording data at this time is the image signal C5 obtained by collating the image signal C4 corresponding to the formed image area C with the multi-value mask MP2 with regard to the nozzle numbers 33 to 64. The recording data at this time is the image signal C5 obtained by collating the multi-value mask MP3 with the image signal C4 corresponding to the formed image area B with regard to the nozzle numbers 65 to 96. The recording data at this time is the image signal C5 obtained by collating the multi-value mask MP4 with the image signal C4 corresponding to the formed image area A with regard to the nozzle numbers 97 to 128 (M4 in the drawing). The arrangement of the ink droplets on the sheet in accordance with the time division driving corresponds to the arrangement illustrated in FIG. 8C. The recording of the formed image area A is completed by the four scannings in step 901 to 904. In this manner, the recording of the unit area (herein, the formed image area A) is performed by the plural scannings. After the scanning, the recording medium P is conveyed by 32 in units of 600 dpi in the +Y direction. In step 905, the nozzle numbers 65 to 128 are used, and the scanning is performed in the +X direction (forward direction) to carry out the recording. The recording data at this time is the image signal C5 obtained by collating the multi-value mask MP3 with the image signal C4 corresponding to the formed image area C with regard to the nozzle numbers 65 to 96. The recording data at this time is the image signal C5 obtained by collating the multi-value mask MP4 with the image signal C4 corresponding to the formed image area B with regard to the nozzle numbers 96 to 128. The arrangement of the ink droplets on the sheet in accordance with the time division driving corresponds to the arrangement illustrated in FIG. 8B. The recording of the formed image area B is completed by the four scannings in steps 902 to 905. After the scanning, the recording medium P is conveyed by 32 in units of 600 dpi in the +Y direction. In step 906, the nozzle numbers 97 to 128 are used, and the scanning is performed in the −X direction to carry out the recording. The recording data at this time is the image signal C5 obtained by collating the multi-value mask MP4 with the image signal C4 corresponding to the formed image area C. The arrangement of the ink droplets on the sheet in accordance with the time division driving corresponds to the arrangement illustrated in FIG. 8C. The recording of the formed image area C is completed by the four scannings in step 903 to 906. After the scanning, the recording medium P is discharged, and the recording operation is ended.

Figure 10A:
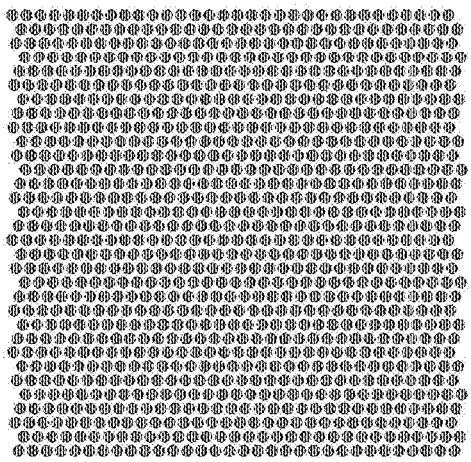
FIGS. 10A to 10E are schematic diagrams of a dot arrangement according to the exemplary embodiment.
Figure 10B:
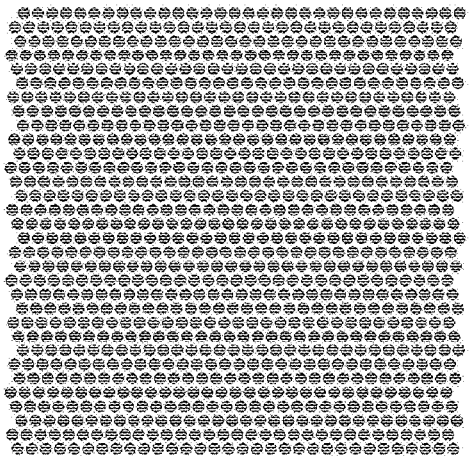
Figure 10C:
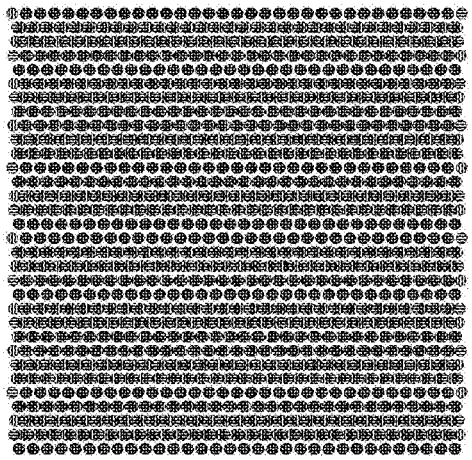
Figure 10D:
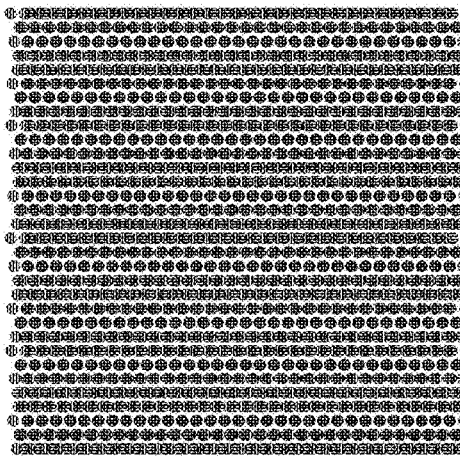
Figure 10E:
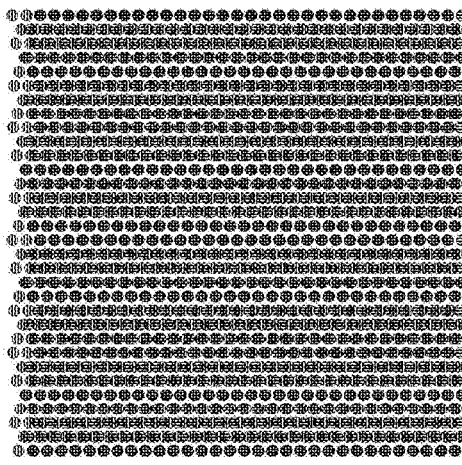

Next, image formation in a case where two dots are arranged per pixel will be described. In a case where the signal value of the image signal C4 is "2" in all the pixels in the formed image area A of FIG. 9, the ink droplets are arranged at the locations having the mask values "1" and "2". That is, the ink droplets are arranged in the hatched parts and the black parts illustrated in FIG. 7A in the first scanning, FIG. 7B in the second scanning, FIG. 7C in the third scanning, and FIG. 7D in the fourth scanning. Among those, the recording is performed in the +X direction (forward direction) in the first scanning and the third scanning, and the recording is performed in the −X direction (backward direction) in the second scanning and the fourth scanning. Accordingly, the locations where the ink droplets are arranged in the +X direction (forward direction) are the hatched parts and the black parts illustrated in FIG. 7E, and the locations where the ink droplets are arranged in the −X direction (backward direction) are the hatched parts and the black parts illustrated in FIG. 7F. That is, the ink droplets are arranged once in the forward direction recording and once in the backward direction recording in all the pixels. FIGS. 10A to 10E illustrate ink droplet arrangements (hereinafter, will be referred to as dot arrangements) at this time while the time division driving is also taken into account. FIG. 10A illustrates the dot arrangement in the +X direction (forward direction), FIG. 10B illustrates the dot arrangement in the −X direction (backward direction), and FIG. 10C illustrates the final dot arrangement in which both the forward scanning and the backward scanning are overlapped with each other. FIG. 10D illustrates the dot arrangement in a case where the backward scanning recording is displaced in the X direction by +21.2 um (=1200 dpi) with respect to the forward scanning recording since a displacement between the scannings occurs in the final dot arrangement of FIG. 10C. FIG. 10E illustrates the dot arrangement in a case where the backward scanning recording is displaced in the X direction by +42.3 um (=600 dpi) with respect to the forward scanning recording since a displacement between the scannings occurs in the final dot arrangement of FIG. 10C. The distance in the X direction between the dots arranged in the same nozzle is 42.3 um (=600 dpi), and the distance in the X direction between the first block and the second block is 2.65 um (=9600 dpi=600 dpi/16). It is illustrated that the part filled with the vertical lines is recorded by the forward scanning, the part filled with the horizontal lines is recorded by the backward scanning, and the part filled with the grid lines is recorded by both the forward scanning and the backward scanning. With reference to FIG. 10C, it may be understood that rows in which the dots based on the forward scanning and the dots based on the backward scanning are substantially overlapped with each other to be recorded, rows in which the dots are partially overlapped with each other, and rows in which the dots are hardly overlapped with each other to be displaced from each other and recorded exist in diverse ways. In FIG. 10D, the dots in the row in which the dots are overlapped with each other newly appear but the dots in the row in which the dots are hardly overlapped with each other to be displaced from each other are newly overlapped with each other, so that the change in the density is cancelled out as a result. In FIG. 10E, the same arrangement as that of FIG. 10C is obtained except both ends in the X direction of the image. When the image as a whole is observed, even when the displacement amount between the scannings in the X direction is either +21.2 um or +42.3 um, it may be understood that the change in the density hardly occurs. In addition, with regard to the image uniformity too, since the row in which the dots are overlapped with each other and the row in which the dots are not overlapped with each other in FIG. 10C and FIG. 10D are merely switched with each other, the overall image uniformity is not decreased even after the displacement. As described above, since the arrangement of FIG. 10E is substantially the same as that of FIG. 10C, when the image as a whole is observed, even when the displacement amount between the scannings in the X direction is either +21.2 um or +42.3 um, it may be understood that the image uniformity is hardly decreased.

With the above-described configuration, in a case where two dots are arranged per pixel, while the image uniformity is maintained, it is possible to suppress the decrease in the image uniformity and the change in the density which appear when the landing displacement between the scannings occurs.

Figure 11A:
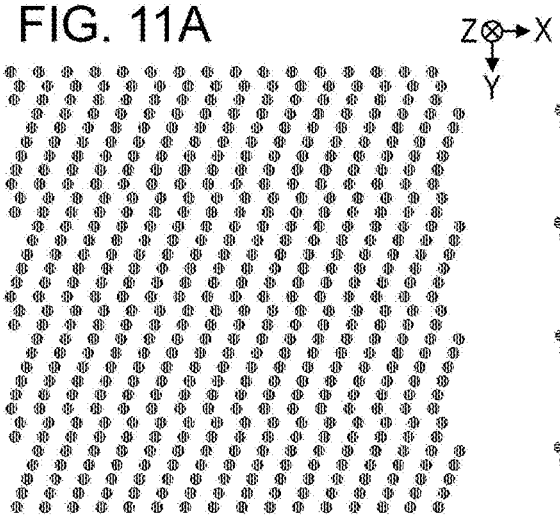
FIGS. 11A to 11E are schematic diagrams of the dot arrangement according to the exemplary embodiment.
Figure 11B:
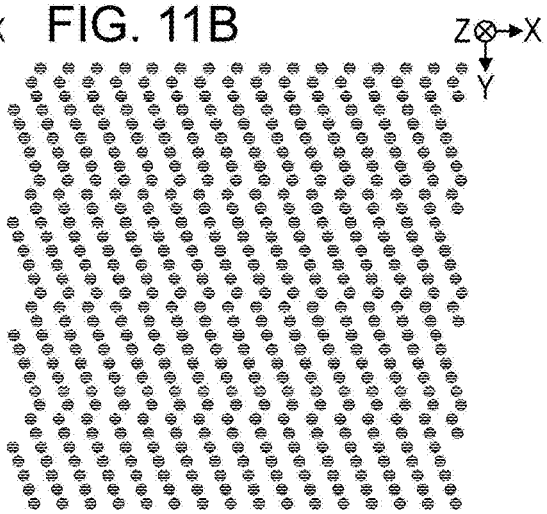
Figure 11C:
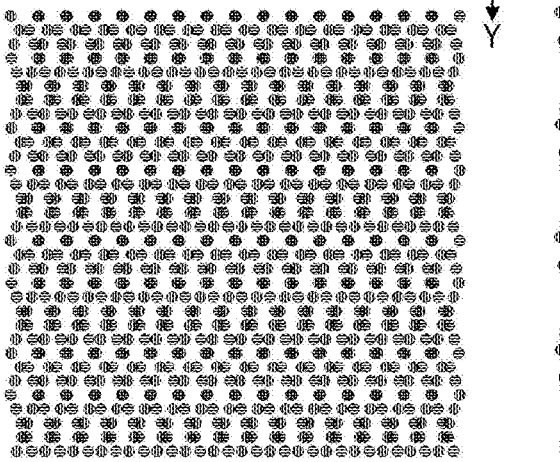
Figure 11D:
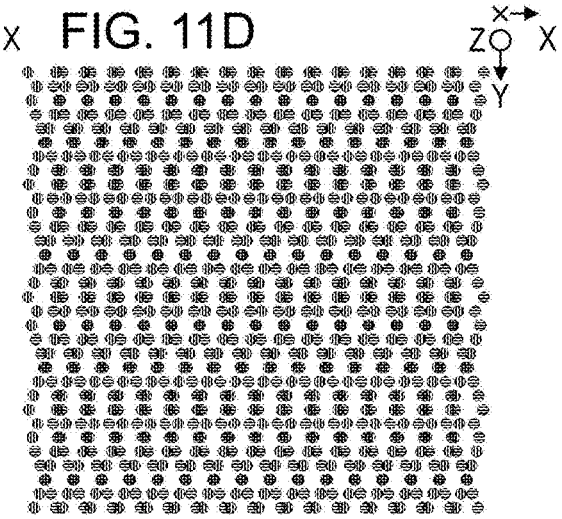
Figure 11E:
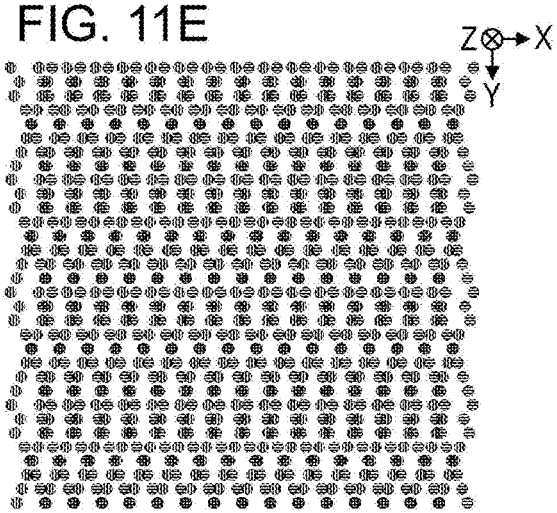

Next, image formation in a case where one dot is arranged per pixel will be described. In a case where the signal value of the image signal C4 is "1" in all the pixels in the formed image area A of FIG. 9, the ink droplets are arranged in the locations having the mask value "1". That is, the ink droplets are arranged in the gray parts illustrated in FIG. 7A in the first scanning, FIG. 7B in the second scanning, FIG. 7C in the third scanning, and FIG. 7D in the fourth scanning. Among them, the recording is performed in the +X direction (forward direction) in the first scanning and the third scanning, and the recording is performed in the −X direction (backward direction) in the second scanning and the fourth scanning. Accordingly, the locations where the ink droplets are arranged in the +X direction (forward direction) are the gray parts illustrated in FIG. 7E, and the locations where the ink droplets are arranged in the −X direction (backward direction) are the gray parts illustrated in FIG. 7F. That is, the ink droplets are arranged with respect to a staggered arrangement of one pixel×one pixel in the forward direction recording and in an inversely staggered arrangement that complements the above-described staggered arrangement in the backward direction recording. FIGS. 11A to 11E illustrate dot arrangements at this time in which the time division driving is also taken into account. FIG. 11A illustrates the dot arrangement in the +X direction (forward direction), FIG. 11B illustrates the dot arrangement in the −X direction (backward direction), and FIG. 11C illustrates the final dot arrangement in which both the forward scanning and the backward scanning are overlapped with each other. FIG. 11D illustrates the dot arrangement in a case where the backward scanning recording is displaced in the X direction by +21.2 um (=1200 dpi) with respect to the forward scanning recording since the displacement between the scannings occurs in the final dot arrangement of FIG. 11C. FIG. 11E illustrates the dot arrangement in a case where the backward scanning recording is displaced in the X direction by +42.3 um (=600 dpi) with respect to the forward scanning recording since the displacement between the scannings occurs in the final dot arrangement of FIG. 11C. Descriptions of the distance in the X direction between the dots arranged in the same nozzle, the distance in the X direction between the first block and the second block, the part filled with the vertical lines, the part filled with the horizontal lines, and the part filled with the grid lines are the same as the above. With reference to FIG. 11C, it may be understood that rows in which the dots based on the forward scanning and the dots based on the backward scanning are substantially overlapped with each other to be recorded, rows in which the dots are partially overlapped with each other, and rows in which the dots are hardly overlapped with each other to be displaced from each other and recorded exist in diverse ways. In FIG. 11D, since the dots in the row in which the dots are overlapped with each other newly appear but the dots in the row in which the dots are hardly overlapped with each other to be displaced from each other are newly overlapped with each other, the change in the density is cancelled out as a result. The same applies to FIG. 11E as in FIG. 11D. Since the dots in the row in which the dots are overlapped with each other newly appear but the dots in the row in which the dots are hardly overlapped with each other to be displaced from each other are newly overlapped with each other, the change in the density is cancelled out as a result. When the image as a whole is observed, even when the displacement amount between the scannings in the X direction is either +21.2 um or +42.3 um, it may be understood that the change in the density hardly occurs. In addition, with regard to the image uniformity too, since the row in which the dots are overlapped with each other and the row in which the dots are not overlapped with each other illustrated in FIG. 11C and FIG. 11D are merely switched with each other, the overall image uniformity is not decreased even after the displacement. The same also applies to FIG. 11E as in FIG. 11D. Since the row in which the dots are overlapped with each other and the row in which the dots are not overlapped with each other are merely switched with each other, the overall image uniformity is not decreased even after the displacement. When the image as a whole is observed, even when the displacement amount between the scannings in the X direction is either +21.2 um or +42.3 um, it may be understood that the image uniformity is hardly decreased.

With the above-described configuration, in a case where one dot is arranged per pixel, while the image uniformity is maintained, it is possible to suppress the decrease in the image uniformity and the change in the density which appear when the landing displacement between the scannings occurs.

According to the present exemplary embodiment, from the tone in which one dot is arranged per pixel to the tone in which two dots are arranged per pixel, it is possible to suppress the decrease in the image uniformity and the change in the density which appear when the landing displacement between the scannings occurs.

According to the present exemplary embodiment, the advantage is attained in the two aspects in which the ink landing positions based on the time division driving are varied in the scannings and the recording is performed in the adjacent pixels in different scanning directions.

Figure 13A:
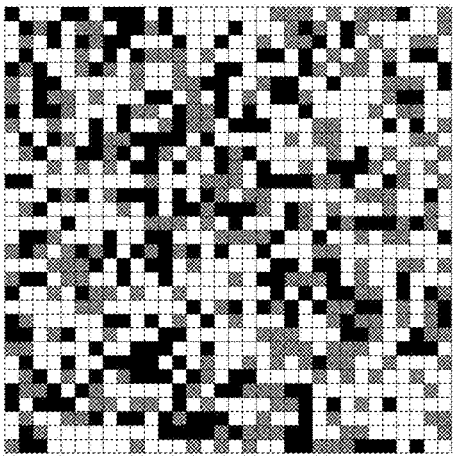
FIGS. 13A to 13F are schematic diagrams of a multi-value mask pattern according to the exemplary embodiment.
Figure 13B:
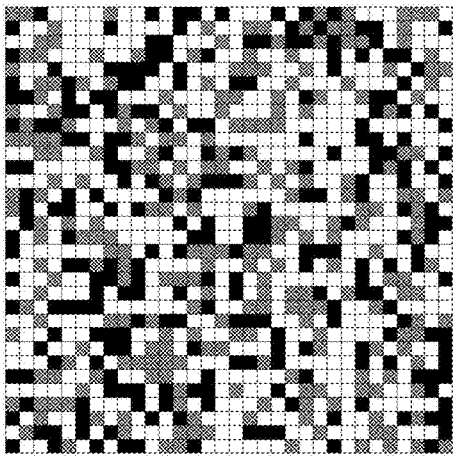
Figure 13C:
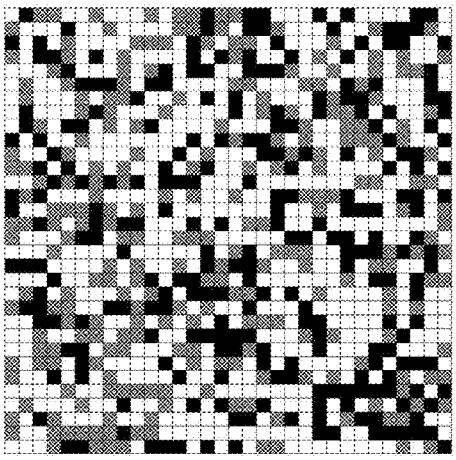
Figure 13D:
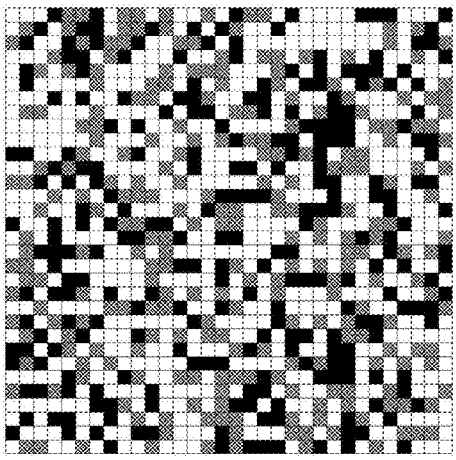
Figure 13E:
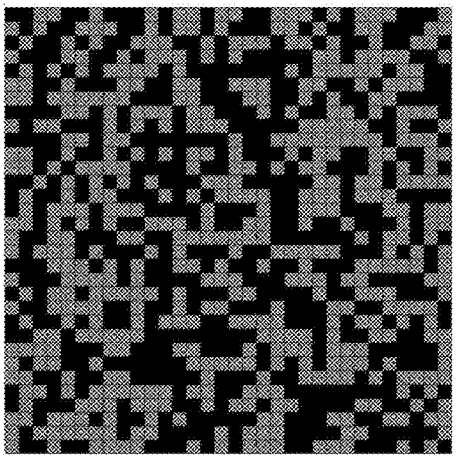
Figure 13F:
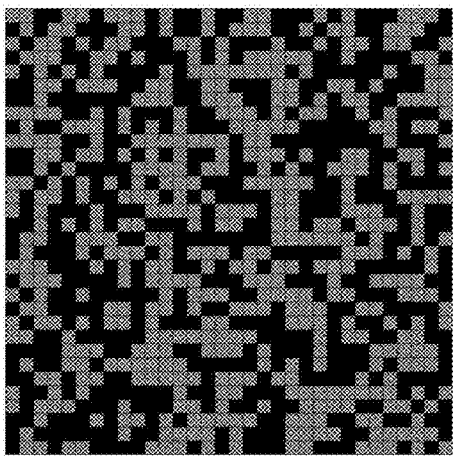
Figure 14A:
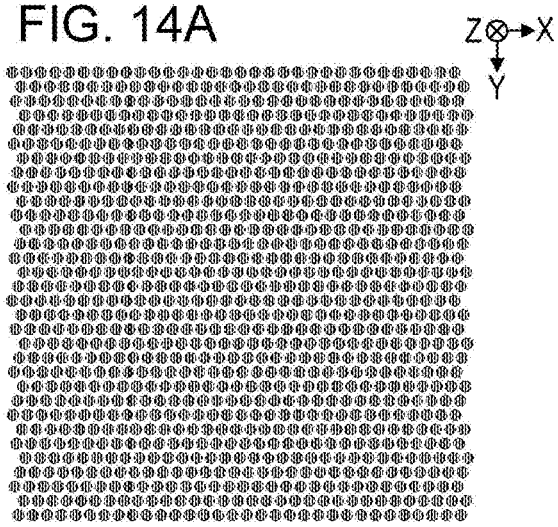
FIGS. 14A to 14E are schematic diagrams illustrating a dot arrangement in a case where two dots are arranged per pixel.
Figure 14B:
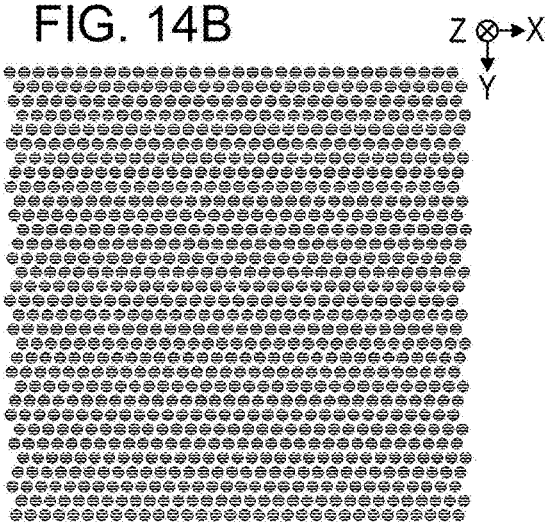
Figure 14C:
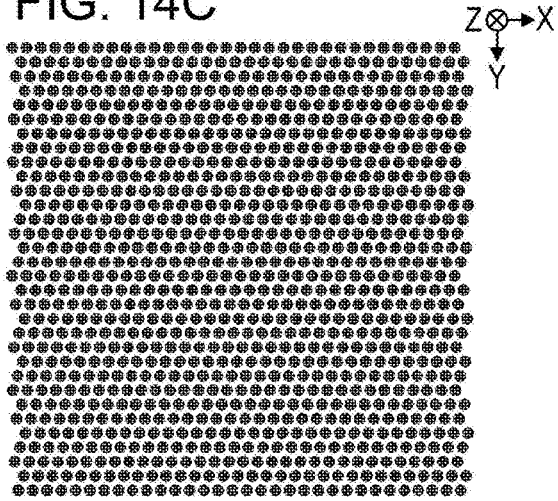
Figure 14D:
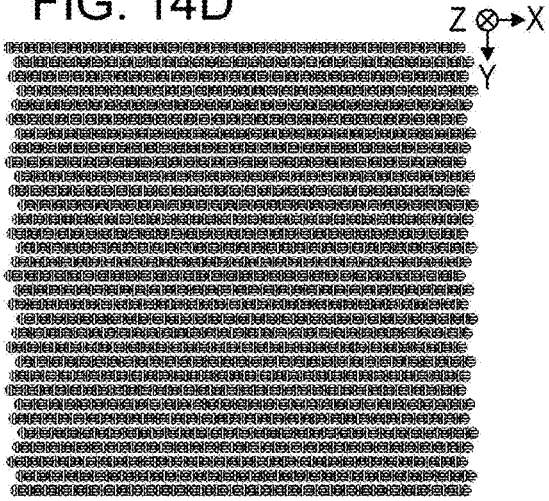
Figure 14E:
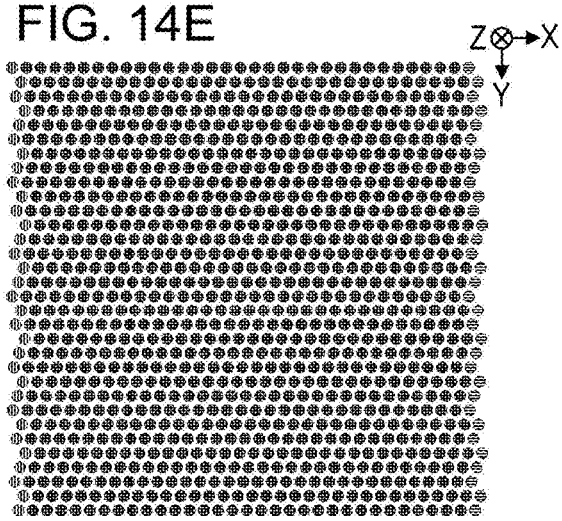
Figure 15A:
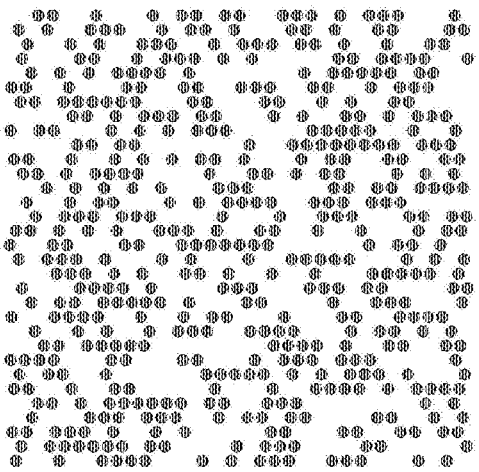
FIGS. 15A to 15E are schematic diagrams illustrating a dot arrangement in a case where one dot is arranged per pixel.
Figure 15B:
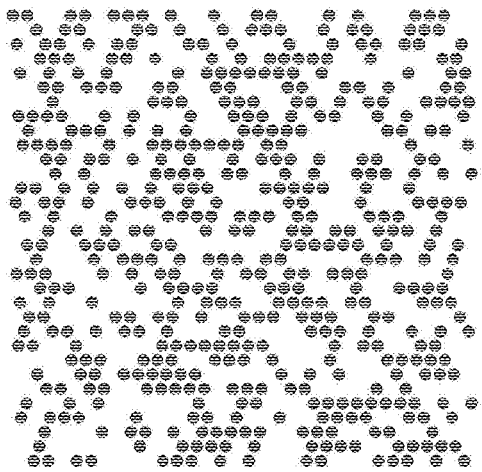
Figure 15C:
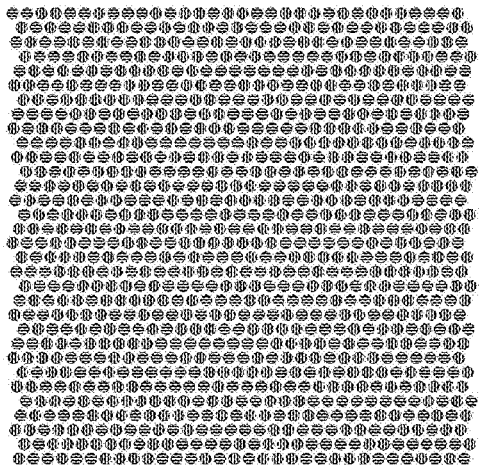
Figure 15D:
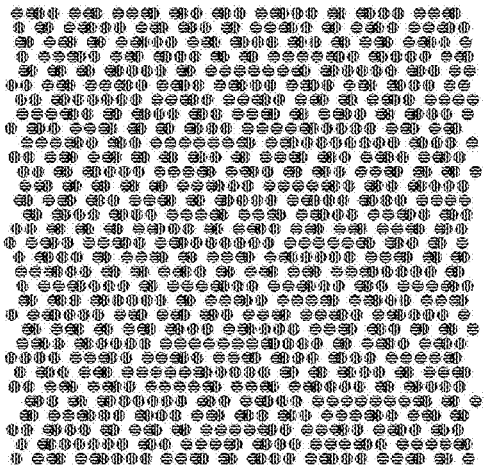
Figure 15E:
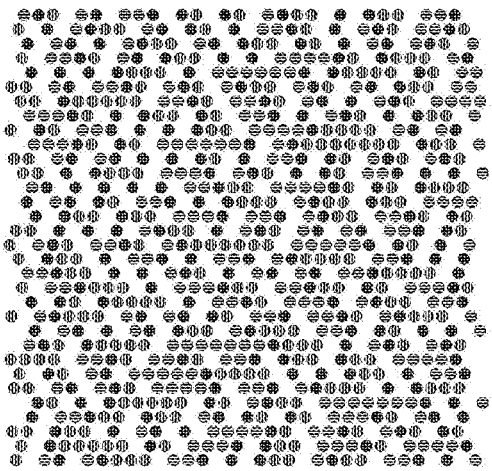

Hereinafter, a case where the ink landing positions based on the time division driving are the same between the scannings and also the scanning directions are randomly set to carry out the recording in the adjacent pixels will be described. FIGS. 12A to 12D illustrate the heater driving order and the arrangement of the ink droplets on the sheet based on the above-described driving order, and FIGS. 13A to 13F illustrate the multi-value mask pattern. The other recording operations are the same as those according to the above-described exemplary embodiment. FIG. 12A is a table indicating the heater driving order at the time of the scanning in the +X direction (forward direction). When a case is supposed where the ejection is performed in response to the image signal C5 for one pixel in the horizontal direction and 16 pixels in the vertical direction in the +X direction (forward direction) in this driving order during the scanning, the arrangement of the ink droplets on the sheet corresponds to the arrangement illustrated in FIG. 12B. This is the same arrangement as FIG. 8B described above. FIG. 12C is a table indicating the heater driving order at the time of the scanning in the −X direction (backward direction). When a case is supposed where the ejection is performed in response to the image signal C5 for one pixel in the horizontal direction and 16 pixels in the vertical direction in the −X direction (backward direction) in the above-described driving order during the scanning, the arrangement of the ink droplets on the sheet corresponds to the arrangement illustrated in FIG. 12D. This is the same arrangement as FIG. 12B, and the ink landing positions based on the time division driving are not varied in the scannings. FIG. 13A illustrates the multi-value mask used in the first scanning, FIG. 13B illustrates the multi-value mask used in the second scanning, FIG. 13C illustrates the multi-value mask used in the third scanning, and FIG. 13D illustrates the multi-value mask used in the fourth scanning. The white part indicates the mask value "0", the hatched part indicates the mask value "1", and the black part indicates the mask value "2". FIG. 13E illustrates the arrangement recorded by the forward scanning in the first scanning+the third scanning, and FIG. 13F illustrates the arrangement recorded by the backward scanning in the second scanning+the fourth scanning. As a feature of the multi-value mask pattern, an arrangement in which the mask values "1" and "2" complement when the four multi-value masks are overlapped with one another is obtained. In addition, as another feature of the multi-value mask pattern, when the multi-value masks used in the first scanning+the third scanning among the four multi-value masks are added to each other, a random arrangement in which the mask values "1" and "2" have a white noise characteristic is obtained (FIG. 13E). Similarly, when the multi-value masks used in the second scanning+the fourth scanning are added to each other, a random arrangement in which the mask values "0" and "1" are inverted with respect to the above-described arrangement is obtained (FIG. 13F). The above-described time division driving order and the multi-value mask pattern are adopted, FIGS. 14A to 14E illustrate a dot arrangement in a case where the value of the image signal C4 becomes "2" in all the pixels, and FIGS. 15A to 15E illustrate a dot arrangement in a case where the value of the image signal C4 becomes "1" in all the pixels. FIG. 14A and FIG. 15A illustrate the dot arrangement in the +X direction (forward direction), FIG. 14B and FIG. 15B illustrate the dot arrangement in the −X direction (backward direction), and FIG. 14C and FIG. 15C illustrate the final dot arrangement in which both the forward scanning and the backward scanning are overlapped with each other. FIG. 14D and FIG. 15D illustrate the dot arrangement in a case where the backward scanning recording is displaced in the X direction by +21.2 um (=1200 dpi) with respect to the forward scanning recording since the displacement between the scannings occurs in the final dot arrangement of FIG. 14C or FIG. 15C. FIG. 14E and FIG. 15E illustrate the dot arrangement in a case where the backward scanning recording is displaced in the X direction by +42.3 um (=600 dpi) with respect to the forward scanning recording since the displacement between the scannings occurs in the final dot arrangement of FIG. 14C or FIG. 15C. Descriptions of the distance in the X direction between the dots arranged in the same nozzle, the distance in the X direction between the first block and the second block, the part filled with the vertical lines, the part filled with the horizontal lines, and the part filled with the grid lines are the same as the above. With reference to FIG. 14D, since the dots entirely overlapped with one another in FIG. 14C appear on the sheet, the density is increased. On the other hand, with reference to FIG. 14E, the state becomes substantially the same as FIG. 14C. When the displacement in the X direction between the scannings occurs, the image uniformity hardly changes, but with regard to the density, it may be understood that the density is increased when the situation is changed from no displacement to the occurrence of the displacement at 21.2 um, and the density is decreased when the displacement is increased from 21.2 um to 42.3 um. With reference to FIG. 15D, it may be understood that parts where the mutual dots are partially overlapped with each other which do not appear at all in FIG. 15C. With reference to FIG. 15E, the mutual dots are further overlapped with each other. With regard to the image uniformity too, the gaps between the dots are uniform in FIG. 15C, but the gaps between the dots are partially expanded in FIG. 15D, and the gaps are further expanded in FIG. 15E so that large gaps are generated at random locations. When the image as a whole is observed, as the displacement amount between the scannings in the X direction is increased to +21.2 um and further increased to +42.3 um, the density is decreased, and the image uniformity is also decreased.

Figure 16A:
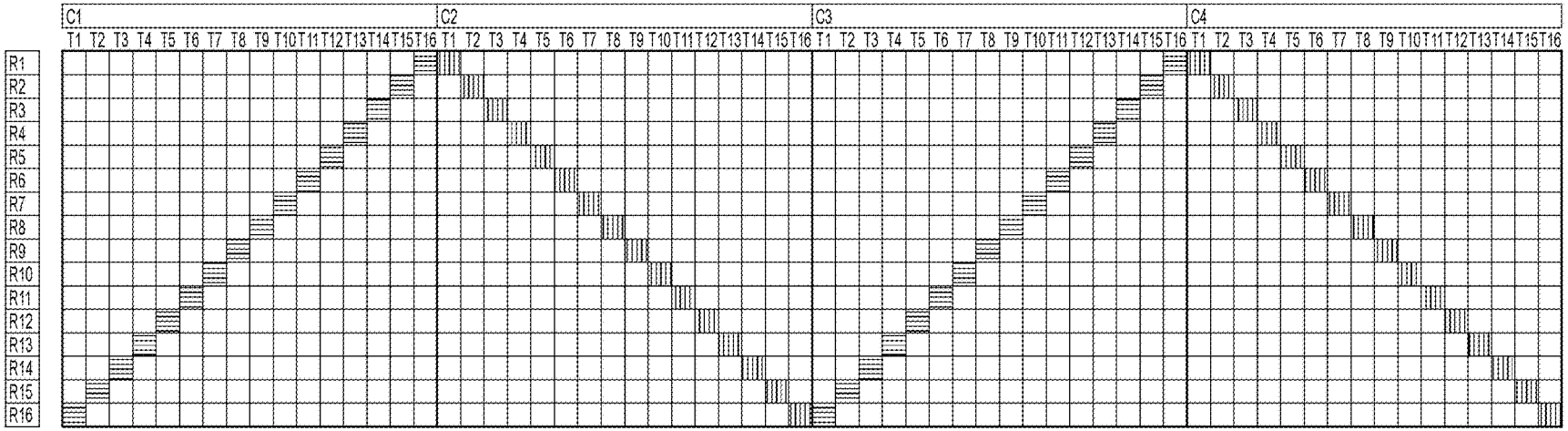
FIGS. 16A to 16C are explanatory diagrams for describing an operational effect according to the exemplary embodiment.
Figure 16B:
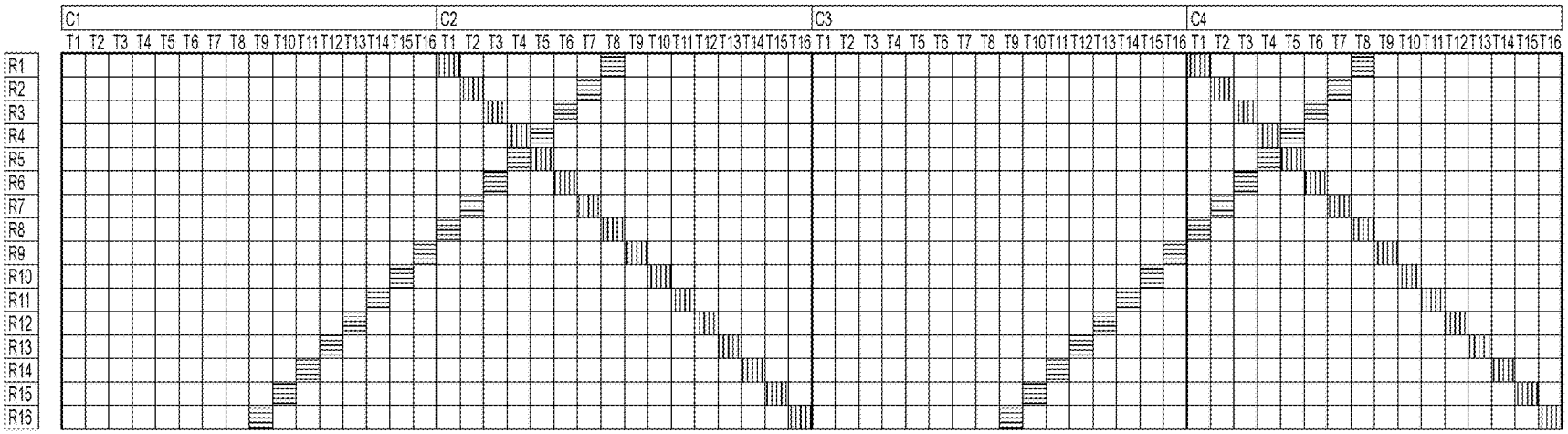
Figure 16C:
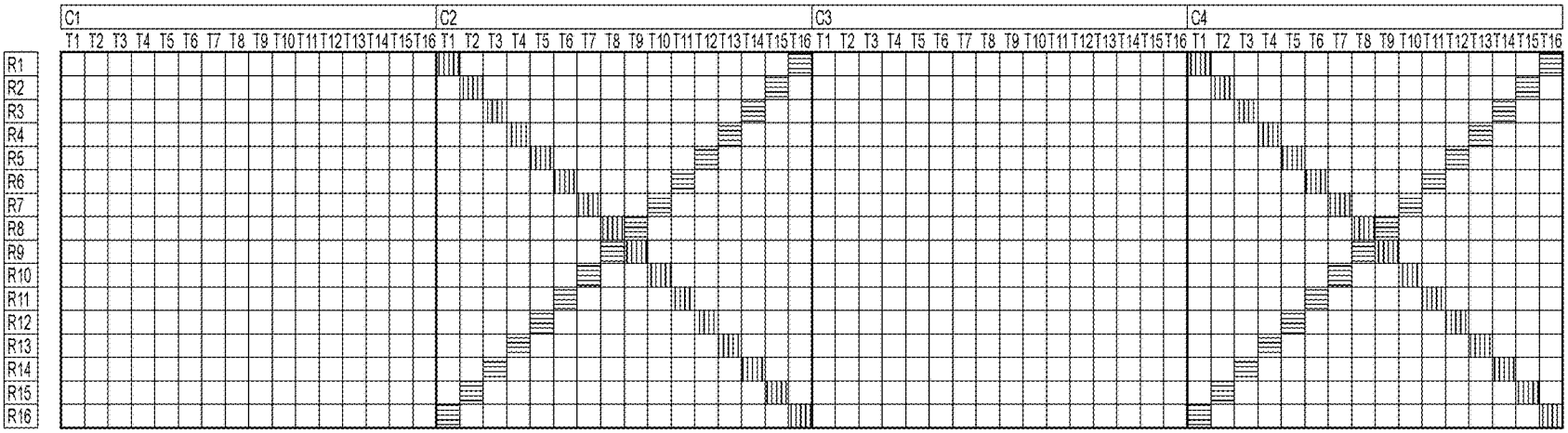

Herein, a mechanism of the production of effect caused by the driving order control at the time of the image recording according to the present exemplary embodiment will be described. In particular, a case where one dot is arranged per pixel will be described in detail. According to the present exemplary embodiment, the arrangement of the ink droplets based on the time division driving order are varied in the forward scanning and the backward scanning, so that the decrease in the image uniformity and the change in the density are suppressed which appear when the landing displacement between the scannings occurs. As a method for varying the arrangements of the ink droplets based on the time division driving order in the scannings, a large effect is attained when the correspondence relationship based on the mirror inversion which is also illustrated in the exemplary embodiment is established. This will be described with reference to FIGS. 16A to 16C. For simplicity of the descriptions, the time division driving order is set in a manner that the ink is ejected from the nozzles of the driving block No. 1 in the respective nozzle sections in the first place, the ink is ejected from the nozzles of the driving block No. 2 in the respective nozzle sections in the second place, the ink is ejected from the nozzles of the driving block No. 3 in the third place, . . . , and the ink is ejected from the driving block No. 16 in the sixteenth place as the driving order. For this reason, the dots are sequentially arranged from the block No. 1 to the block No. 16 in the +X direction in the case of the forward direction recording, and the dots are sequentially arranged from the block No. 1 to the block No. 16 in the −X direction in the case of the backward direction recording. In addition, with regard to the feature of the mask pattern in the same scanning direction, the pattern in which the backward direction recording•the forward direction recording•the backward direction recording•the forward direction recording are arranged alternately for every column is adopted. The mask size of the present exemplary embodiment is 32 in both the vertical direction and the horizontal direction, but as seen in the repetition cycle of the mask pattern, the Y direction is 8, and the X direction is 2. When the state in which the repetition cycle based on the time division driving is 16 in the Y direction is taken into account, it is sufficient to deliberate the description model having the size of 16 in the Y direction and 2 in the X direction. FIGS. 16A to 16C illustrate dot coordinates in a case where the signal value in all the pixels for the image signal C4 having the size of 16 in the vertical direction×4 in the horizontal direction on the basis of the above-described driving order and the mask pattern is "1". FIG. 16A illustrates the dot coordinates in a case where the displacement between the forward and backward scannings does not occur, FIG. 16B illustrates the dot coordinates in a case where the displacement amount between the forward and backward scannings is +21.2 um (=1200 dpi), and FIG. 16C illustrates the dot coordinates in a case where the displacement amount between the forward and backward scannings is +42.3 um (=600 dpi). A cell filled with the vertical lines indicates a location where the dot is arranged by the forward direction recording, and a cell filled with the horizontal lines indicates a location where the dot is arranged by the backward direction recording. The vertical size of the cell is 600 dpi, and the horizontal size is 9600 dpi (=6000 dpi/16). With regard to the horizontal direction, 16 cells constitute data for one column at 600 dpi (=9600 dpi×16). In FIG. 16B, the dot coordinates based on the backward direction scanning are displaced in the +X direction by 1200 dpi=9600 dpi×8 cells with respect to FIG. 16A. Herein, when attention is paid to the fifth row (R5) in FIG. 16B, the dot in the backward direction is arranged in the X direction at T4 in C2, and the dot in the forward direction is arranged at the adjacent T5 in C2. From that point, a blank space continues for 30 cells. Then, the dot in the backward direction is arranged at T4 in C4, and the dot in the forward direction is arranged at the adjacent T5 in C4. The relationship between the forward direction and the backward direction with respect to this dot coordinate is the same as that in the first row (R1) in FIG. 16A. Similarly, the relationship between the forward direction and the backward direction with respect to the dot coordinate in the sixth row (R6) in FIG. 16B is the same as that in the second row (R2) in FIG. 16A. In this manner, a pair having the same relationship between the forward direction and the backward direction with respect to the dot coordinate is to exist in FIG. 16B and FIG. 16A. In FIG. 16C, the dot coordinates based on the backward direction scanning are displaced in the +X direction by 600 dpi=9600 dpi×16 cells with reference to FIG. 16A. With reference to the ninth row (R9) in FIG. 16C, it may be understood that the situation is the same as the first row (R1) in FIG. 16A. Subsequently, with reference to the tenth row (R10) in FIG. 16C, the situation is the same as the second row (R2) in FIG. 16A, for example. Thus, a pair having the same relationship between the forward direction and the backward direction with respect to the dot coordinate is to exist in FIG. 16C and FIG. 16A too. This is because the dot arrangement based on the time division driving has the mirror inversion in the forward direction and the backward direction, and the relationship between the forward direction and the backward direction with respect to the dot coordinate is varied in all the rows.

As described above, even in a case where the displacement between the forward and backward scannings occurs, the pair having the same relationship between the forward direction and the backward direction as that in a case where no displacement occurs is to exist, and it is possible to suppress the change in the density in a case where the displacement between the forward and backward scannings occurs.

Figure 17A:
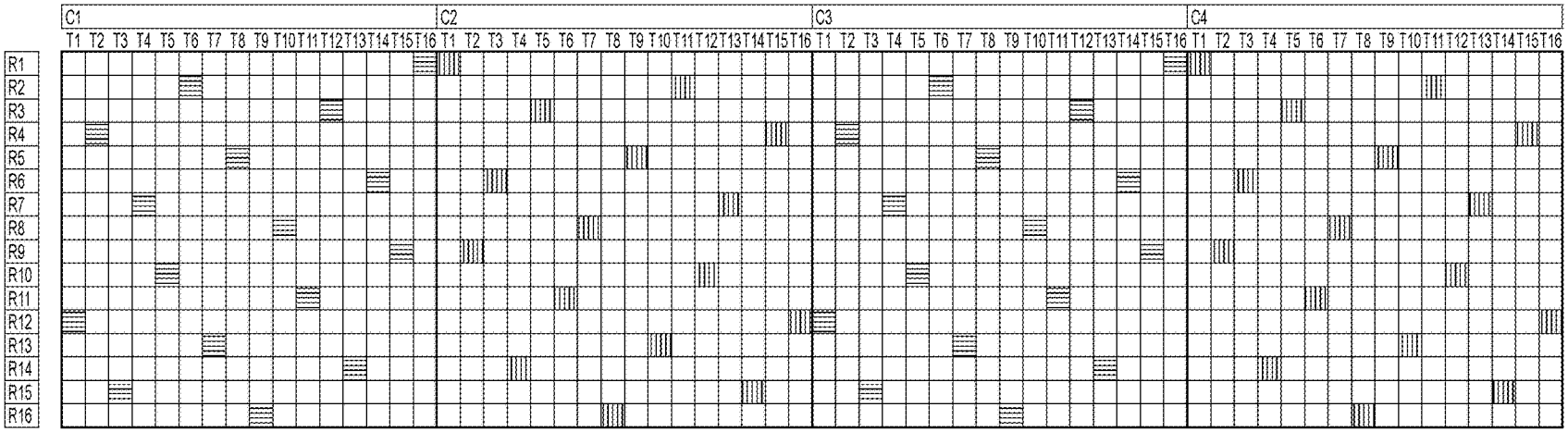
FIGS. 17A to 17C are explanatory diagrams for describing the operational effect according to the exemplary embodiment.
Figure 17B:
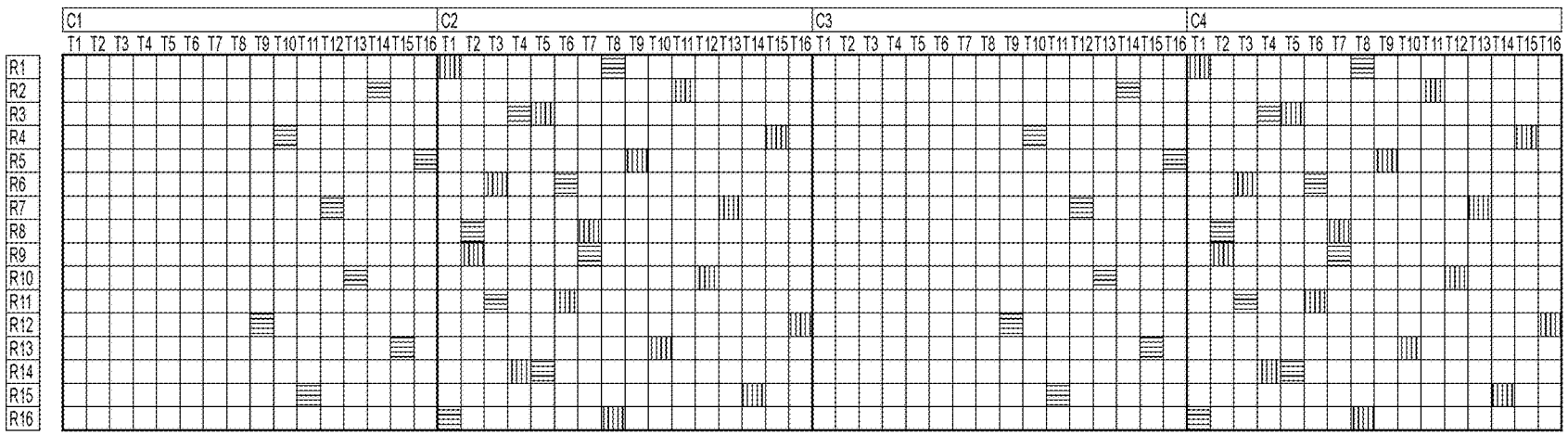
Figure 17C:
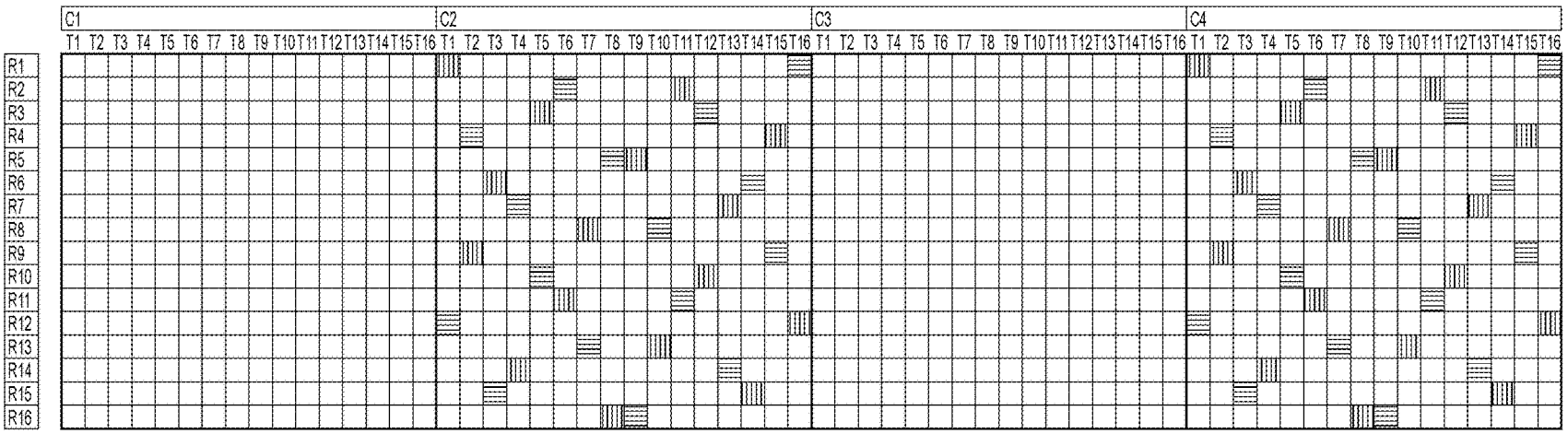

Herein, the example has been described in which the time division driving has the driving order for sequentially driving from the block No. 1 to the block No. 16, and the mirror inversion exists in the forward direction and the backward direction, but a driving order different from this driving order may be used. This is because, when the driving order is changed while the dot arrangement has the relationship of the mirror inversion in the forward direction and the backward direction is maintained, a particular row and another row in FIGS. 16A to 16C are merely switched with each other, and the relationship between the forward direction and the backward direction with respect to the dot coordinate in the switching rows is not changed. FIGS. 17A to 17C correspond to the change to the time division driving order (FIGS. 8A to 8C) with respect to FIGS. 16A to 16C. A cell filled with the vertical lines indicates a location where the dot is arranged in the forward direction recording, and a cell filled with the horizontal lines indicates a location where the dot is arranged in the backward direction recording. FIG. 17A corresponds to a case where the displacement between the forward and backward scannings does not occur, FIG. 17B corresponds to a case where the displacement amount between the forward and backward scannings is +21.2 um (=1200 dpi), and FIG. 17C corresponds to a case where the displacement amount between the forward and backward scannings is +42.3 um (=600 dpi). A cell further displaced to the right side with respect to the column C4 is regarded as going around and added to the column C1. When a case where the displacement between the forward and backward scannings does not occur is compared with only a case where the displacement amount is 42.3 um, the rows in which the coordinate relationship between the forward direction and the backward direction are matched with each other are to exist as in R5 in FIG. 17C and R1 in FIG. 17A, R6 in FIG. 17C and R2 in FIG. 17A, R7 in FIG. 17C and R3 in FIG. 17A, . . . .

Figure 18A:
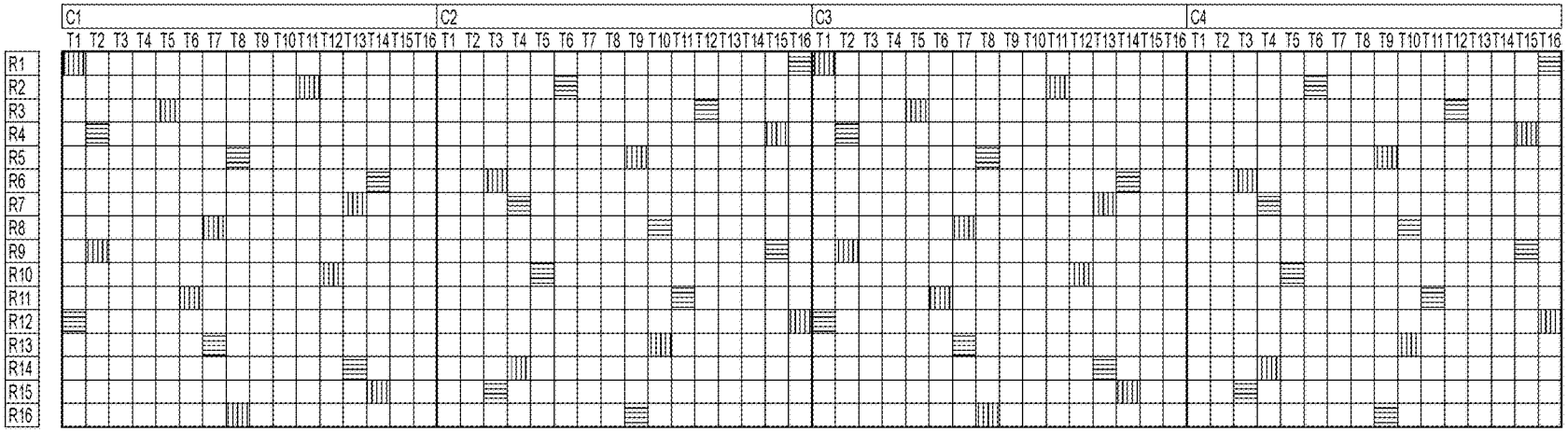
FIGS. 18A to 18C are explanatory diagrams for describing the operational effect according to the exemplary embodiment.
Figure 18B:
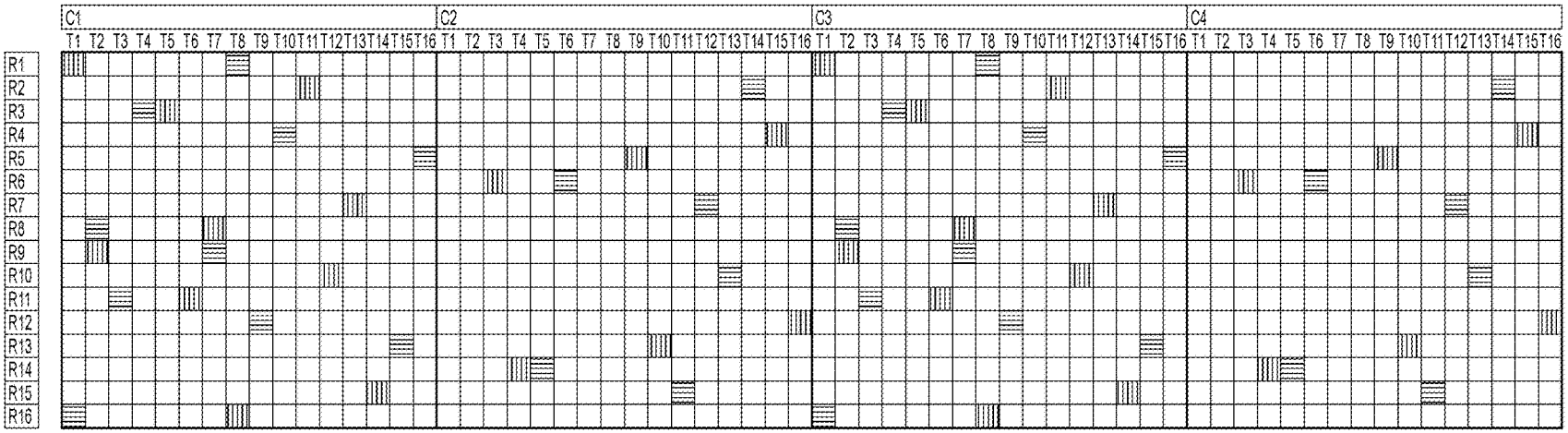
Figure 18C:
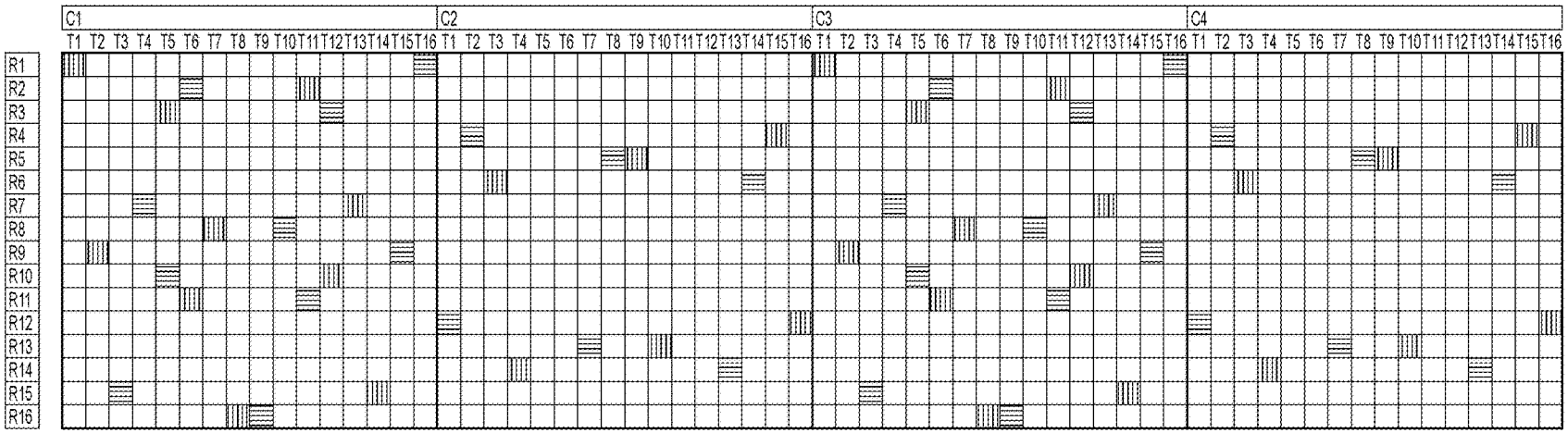

However, in a case where the displacement amount between the forward and backward scannings is +42.3 um as it is, the dots are concentrated in the column C2 and the column C4, and the image uniformity is degraded. In view of the above, the feature of the mask pattern in the same scanning direction is changed to a pattern in which a particular row is shifted in the X direction instead of the pattern in which the backward direction recording•the forward direction recording•the backward direction recording•the forward direction recording are alternately arranged. Even when the particular row is shifted in the X direction, the relationship between the forward direction and the backward direction with respect to the dot coordinate in the row is not changed, and the rows in which the coordinate relationship between the forward direction and the backward direction are matched with each other continue to exist. In contrast to the pattern in which the backward direction recording•the forward direction recording•the backward direction recording•the forward direction recording are arranged alternately for every column, a pattern in which the rows 1, 2, 3, 7, 8, 9, 10, 11, 15, and 16 are shifted in the X direction by +1 column is equivalent to the houndstooth check pattern of the exemplary embodiment, which will be described as an example. FIGS. 18A to 18C illustrate a configuration in which changes are made to the time division driving order (FIGS. 8A to 8C) and the multi-value mask pattern (FIG. 7E and FIG. 7F) with respect to the configuration of FIGS. 16A to 16C. FIG. 18A corresponds to a case where the displacement between the forward and backward scannings does not occur, FIG. 18B corresponds to a case where the displacement amount between the forward and backward scannings is +21.2 um (=1200 dpi), and FIG. 18C corresponds to a case where the displacement amount between the forward and backward scannings is +42.3 um (=600 dpi). Since FIGS. 18A to 18C correspond to a state obtained by merely shifting a particular row in the X direction with respect to FIGS. 17A to 17C, combinations of the rows in which the coordinate relationship between the forward direction and the backward direction are matched with each other are the same as FIGS. 17A to 17C. Similarly, a cell filled with the vertical lines indicates a location where the dot is arranged in the forward direction recording, and a cell filled with the horizontal lines indicates a location where the dot is arranged in the backward direction recording. Even in a case where the displacement amount between the forward and backward scannings is +42.3 um, since the dots are relatively dispersed without being concentrated in the columns C2 and C4, it is possible to improve the image uniformity.

Figure 19A:
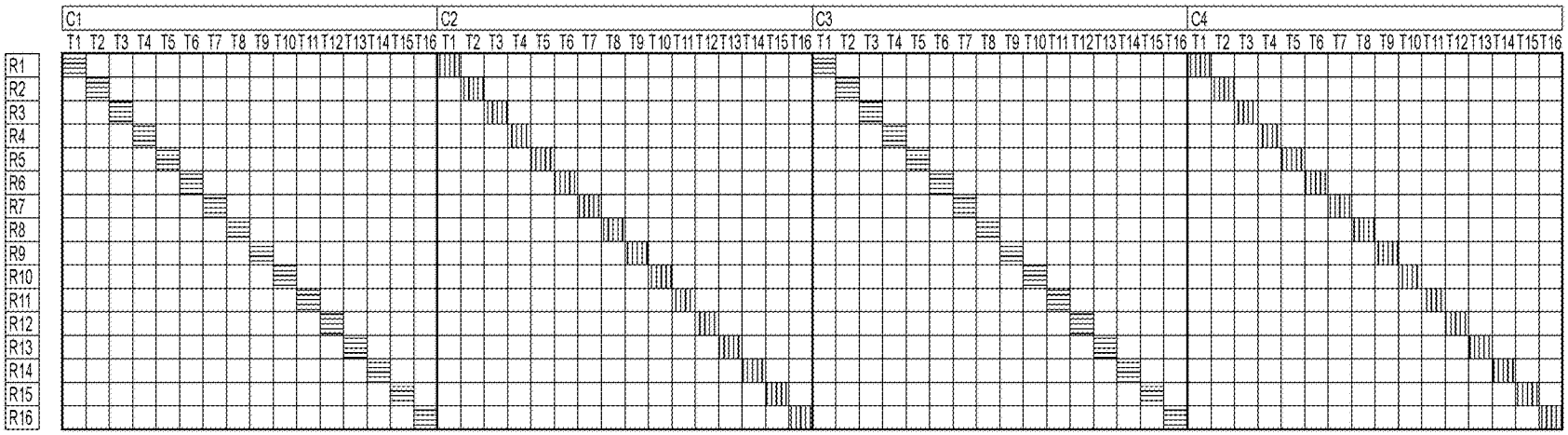
FIGS. 19A to 19C are explanatory diagrams for describing the operational effect according to the exemplary embodiment.
Figure 19B:
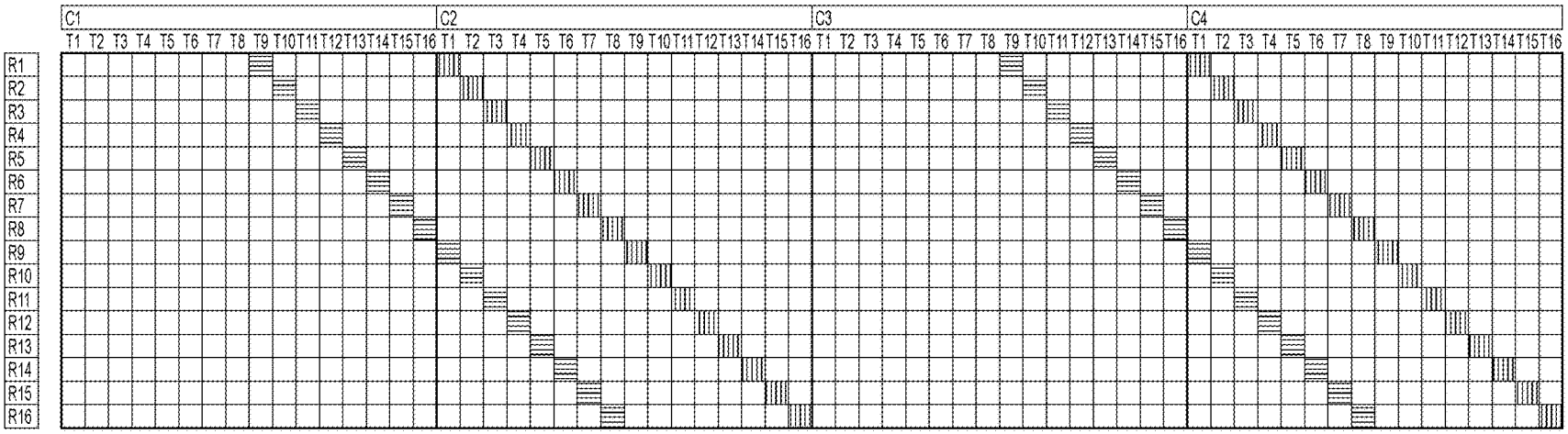
Figure 19C:
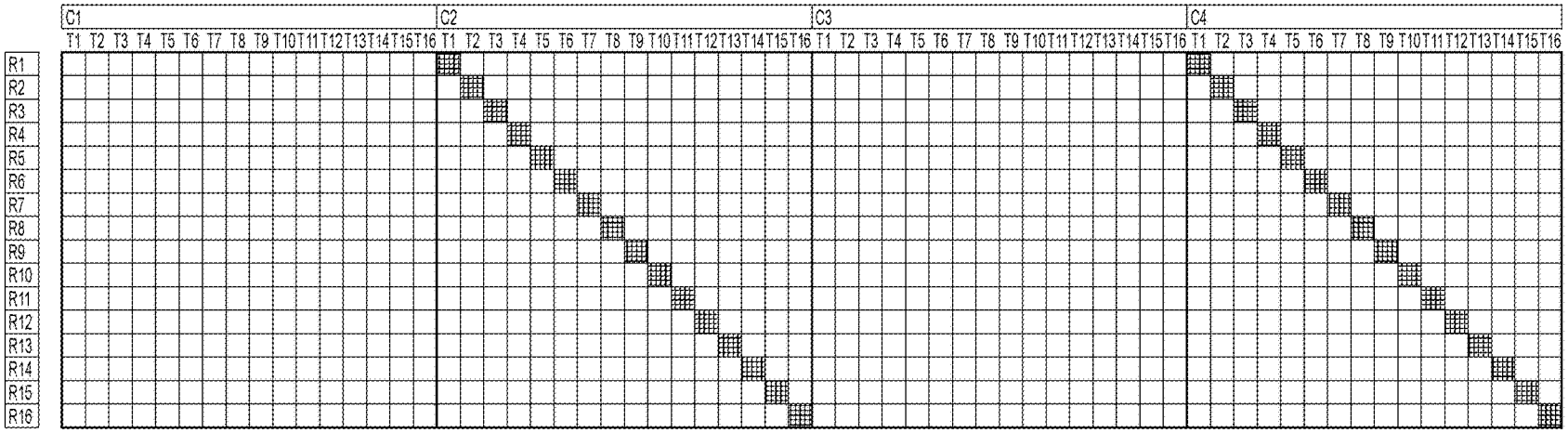

The above-described effect becomes extremely conspicuous when the manner of varying the arrangement of the ink droplets based on the time division driving order in the forward scanning and the backward scanning is the mirror inversion, but the manner is not limited to the mirror inversion, and the effect can be attained as long as the ink droplet arrangements between the forward and backward scannings are different from each other. That is, it is sufficient if a case where the relationship between the forward direction and the backward direction with respect to the dot coordinate is the same in all the rows is avoided. FIGS. 19A to 19C illustrate an example in which the dot arrangement based on the time division driving in the forward direction and the dot arrangement based on the time division driving in the backward direction are the same in all the rows. Similarly as in FIGS. 16A to 16C, FIGS. 17A to 17C, and FIGS. 18A to 18C, a cell filled with the vertical lines indicates a location where the dot is arranged in the forward direction recording, and a cell filled with the horizontal lines indicates a location where the dot is arranged in the backward direction recording. A driving order is set such that, with regard to the forward direction, the ink is ejected from the nozzles of the driving block No. 1 in the respective nozzle sections in the first place, the ink is ejected from the nozzles of the driving block No. 2 in the respective nozzle sections in the second place, the ink is ejected from the nozzles of the driving block No. 3 in the first place, . . . , and the ink is ejected from the nozzles of the driving block No. 16 in the sixteenth place. A driving order is set such that, with regard to the backward direction, the ink is ejected from the nozzles of the driving block No. 16 in the respective nozzle sections in the first place, the ink is ejected from the nozzles of the driving block No. 15 in the respective nozzle sections in the second place, the ink is ejected from the nozzles of the driving block No. 14 in the third place, . . . , and the ink is ejected from the nozzles of the driving block No. 1 in the sixteenth place. For this reason, the dots are sequentially arranged in the +X direction from the block No. 1 to the block 16 in both the forward direction recording and the backward direction recording. As the feature of the mask pattern in the same scanning direction, a pattern in which the backward direction recording•the forward direction recording•the backward direction recording•the forward direction recording are arranged alternately for every column is used. FIG. 19A corresponds to a case where the displacement between the forward and backward scannings does not occur, FIG. 19B corresponds to a case where the displacement amount between the forward and backward scannings is +21.2 um (=1200 dpi), and FIG. 19C corresponds to a case where the displacement amount between the forward and backward scannings is +42.3 um (=600 dpi). In FIG. 19A, the dots in the forward direction and the dots in the backward direction are arranged while blank space for 15 cells are arranged in all the rows. In FIG. 19B, the blank space is changed from 15 cells to eight cells. In FIG. 19C, no blank space appears, and the dots in the forward direction and the dots in the backward direction are overlapped with each other in all the rows. That is, in a case where the displacement between the forward and backward scannings occurs, the distance at which the dots are arranged in the forward and backward directions is changed in all the rows. According to this mode described above, even when the time division driving order is changed, even if the mask patterns in the forward and backward scannings are changed, the rows in which the coordinate relationship between the forward direction and the backward direction are matched with each other are not generated, so that the effect of the suppression of the density does not appear with respect to the displacement between the scannings.

In addition, a configuration is preferably adopted in which the relationship between the forward scanning and the backward scanning with regard to the dot coordinates is not the same, and furthermore, the dot arrangement in the backward scanning is not an dot arrangement obtained through offset of the dot arrangement in the forward scanning. With the above-described configuration, the patterns of the dot arrangements in the respective forward and backward scannings are not similar to each other, and the above-described cancelling effect of the change in the density is increased. To avoid the dot arrangement obtained through the offset of the dot arrangement in the forward scanning, an offset relationship in which the driving order with respect to the array of the nozzle is an inverse order is not established in the forward scannings and the backward scanning. Descriptions will be given of a method of determining pixels to be recorded in the respective forward and backward scannings, in which the dot arrangement based on the time division driving is varied to avoid the case where the relationship between the forward scannings and the backward scanning is the same in all the rows as described above to reliably realize the effect of suppressing the fluctuation of the density. First, a case will be described where the ink landing positions based on the time division driving are varied in the scannings, and also in which scanning direction is randomly determined to record the adjacent pixel.

Figure 20A:
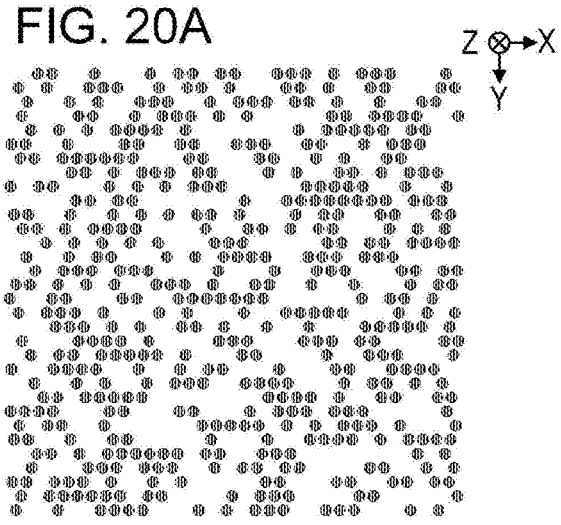
FIGS. 20A to 20E are schematic diagrams illustrating a dot arrangement in a case where one dot is arranged per pixel.
Figure 20B:
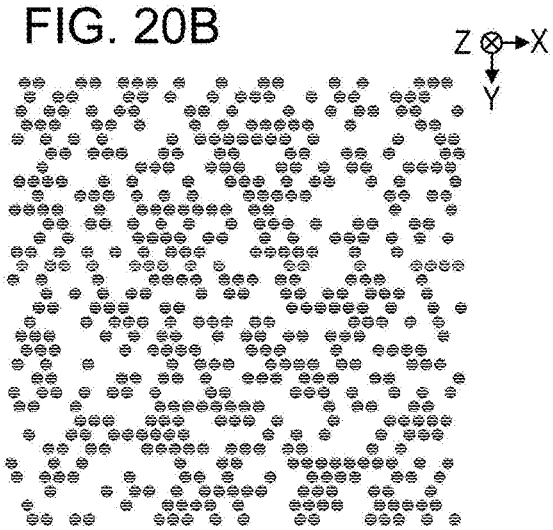
Figure 20C:
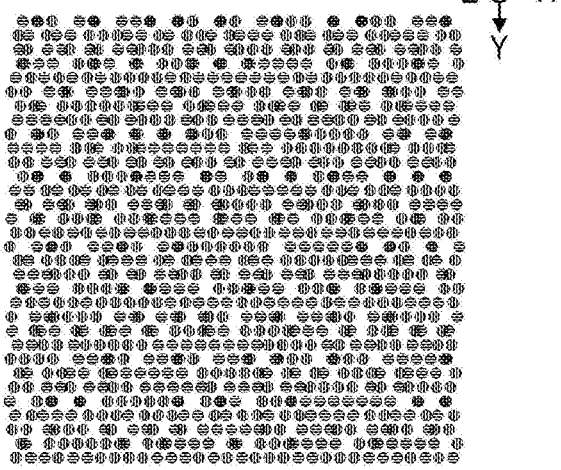
Figure 20D:
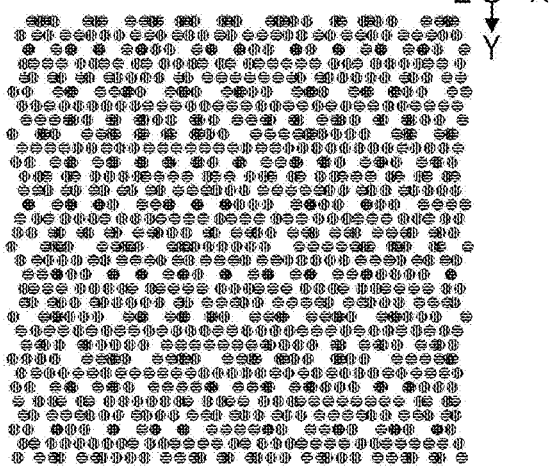
Figure 20E:
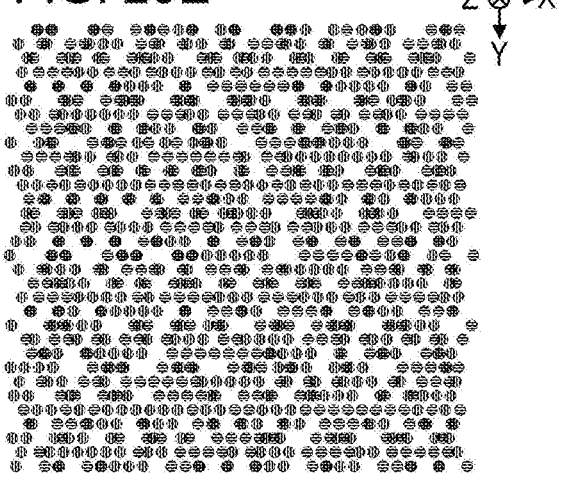

The heater driving order and the arrangement of the ink droplets on the sheet based on the above-described driving order use the configuration illustrated in FIGS. 8A to 8C in which the mirror arrangement is established in the forward and backward scanning directions, and the multi-value mask pattern uses the configuration illustrated in FIGS. 13A to 13F in which in which scanning direction is randomly determined to record the adjacent pixels in response to the mask value "1". The other recording operations are the same as those according to the above-described exemplary embodiment. FIGS. 20A to 20E illustrate the dot arrangement in a case where the value of the image signal C4 becomes "1" in all the pixels by adopting the time division driving order of FIGS. 8A to 8C and the multi-value mask pattern of FIGS. 13A to 13F. A case where the value of the image signal C4 becomes "2" in all the pixels is the same as the exemplary embodiment, and descriptions thereof will be omitted. FIG. 20A illustrates the dot arrangement in the +X direction (forward direction), FIG. 20B illustrates the dot arrangement in the −X direction (backward direction), and FIG. 20C illustrates the final dot arrangement in which both the forward scanning and the backward scanning are overlapped with each other. FIG. 20D illustrates the dot arrangement in a case where the backward scanning recording is displaced in the X direction by +21.2 um (=1200 dpi) with respect to the forward scanning recording since the displacement between the scannings occurs in the final dot arrangement of FIG. 20C. FIG. 20E illustrates the dot arrangement in a case where the backward scanning recording is displaced in the X direction by +42.3 um (=600 dpi) with respect to the forward scanning recording since the displacement between the scannings occurs in the final dot arrangement of FIG. 20C. Descriptions of the distance in the X direction between the dots arranged in the same nozzle, the distance in the X direction between the first block and the second block, the part filled with the vertical lines, the part filled with the horizontal lines, and the part filled with the grid lines are the same as the above. With reference to FIG. 20D, it looks like that the blank area is slightly increased as compared with FIG. 20C. With reference to FIG. 20E, the increase in the blank area becomes conspicuous. On the other hand, with regard to the image uniformity too, as compared with FIG. 11C, the number of the gaps between the dots is low, but the gaps exist in a non-uniform manner with reference to FIG. 20C. With reference to FIG. 20D, the above-described gaps between the dots are partially expanded. With reference to FIG. 20E, the gaps are further expanded, and the non-uniformity of the gaps becomes conspicuous. When the image as a whole is observed, as the displacement amount between the scannings in the X direction is increased to +21.2 um and further to +42.3 um, the change in the density is increased, and the image uniformity is decreased.

According to the above-described exemplary embodiment, the ink droplet arrangement based on the time division driving is varied in the forward direction and the backward direction to generate a location where the dots are overlapped with each other (that is, the ink landing positions in the forward direction recording and the backward direction recording are close to each other) and a location where the dots are not overlapped with each other (that is, the ink landing positions in the forward direction recording and the backward direction recording are far from each other). As a result, an image robustness with respect to the displacement between the scannings can be improved. However, when the adjacent dots are arranged in the same scanning direction, the adjacent dots have the arrangement based on the same time division driving order. Therefore, the landing positions between the dots are at a distance that is neither close nor far. Thus, to more effectively attain the effect of suppressing the change in the density based on the above-described driving order, the scanning directions for the adjacent dots are preferably varied. In the mask pattern in which the forward direction recording and the backward direction recording are randomly arranged, the adjacent pixels are partially arranged in the same scanning direction. On the other hand, in the mask pattern in which the above-described arrangement of the pixels in the forward direction recording and the backward direction recording has the relationship of the houndstooth check or the inverted houndstooth check, all the adjacent pixels are arranged in the different scanning directions, and the effect is conspicuous. It should be noted that all the adjacent pixels do not necessarily need to be arranged in different scanning directions, and when the number of the adjacent pixels is higher than the pixel that are not adjacent to each other in all the rows, it is possible to attain the sufficient effect of suppressing the density fluctuation based on the above-described driving order.

Figure 21A:
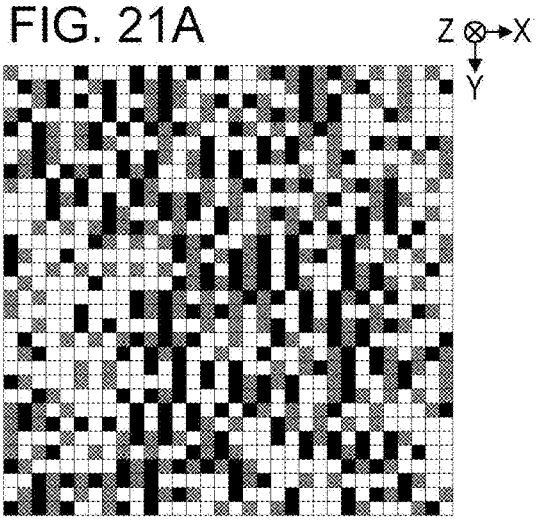
FIGS. 21A to 21F are schematic diagrams of the multi-value mask pattern according to the exemplary embodiment.
Figure 21B:
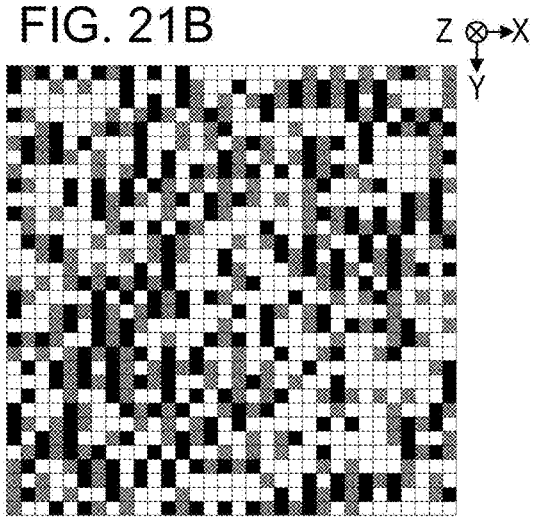
Figure 21C:
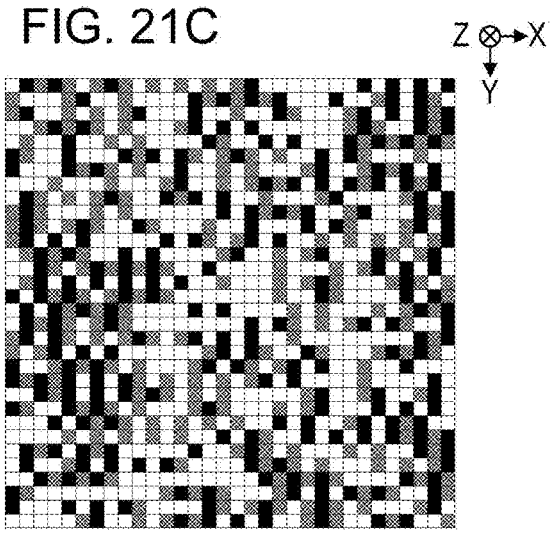
Figure 21D:
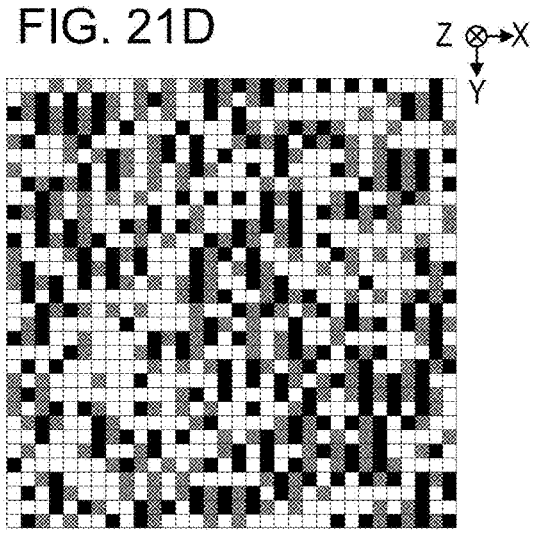
Figure 21E:
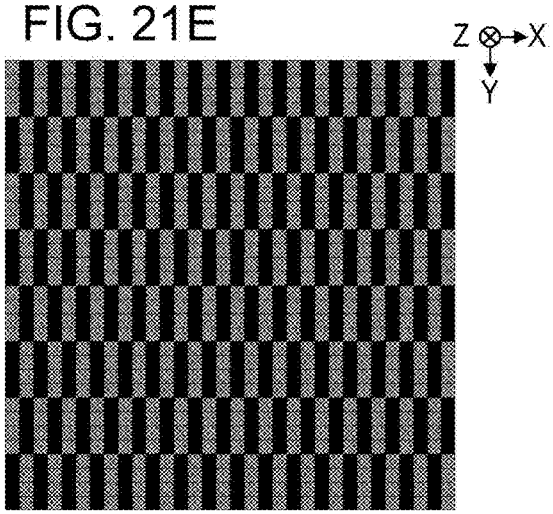
Figure 21F:
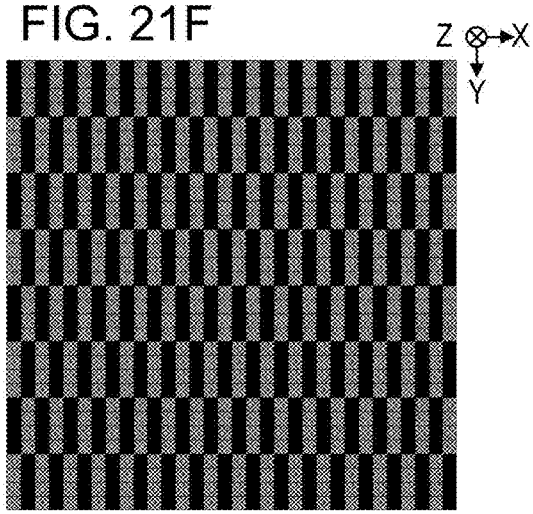
Figure 22A:
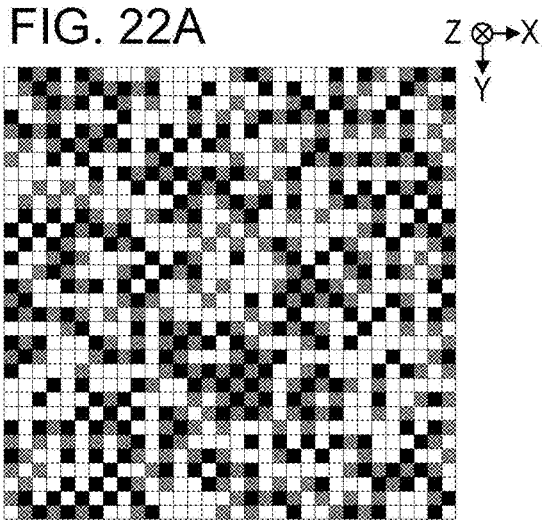
FIGS. 22A to 22F are schematic diagrams of the multi-value mask pattern according to the exemplary embodiment.
Figure 22B:
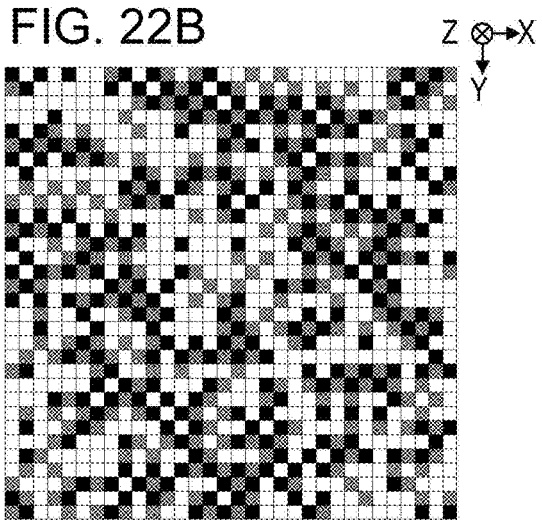
Figure 22C:
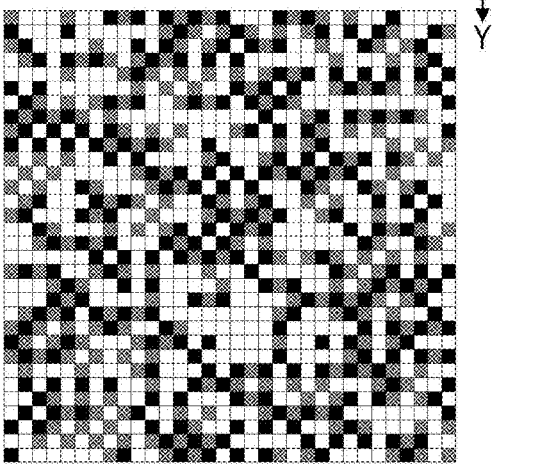
Figure 22D:
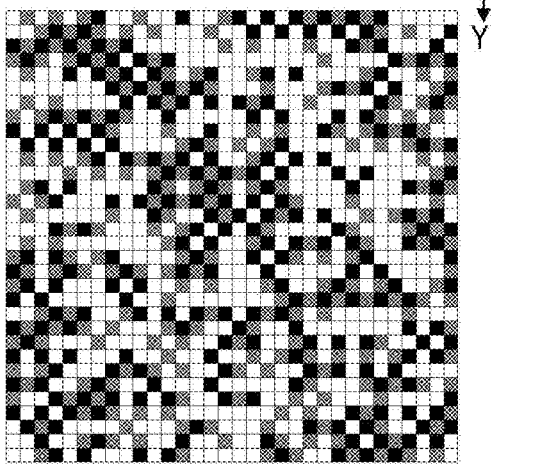
Figure 22E:
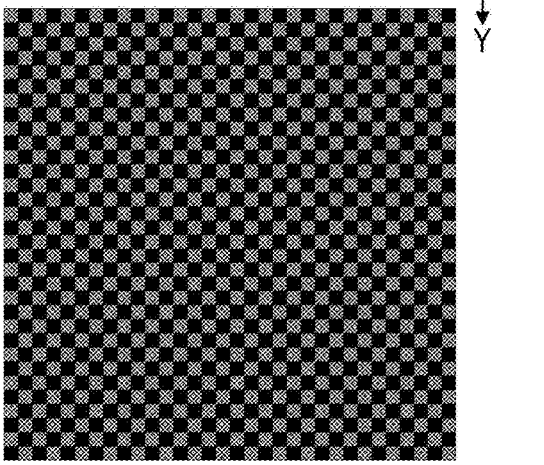
Figure 22F:
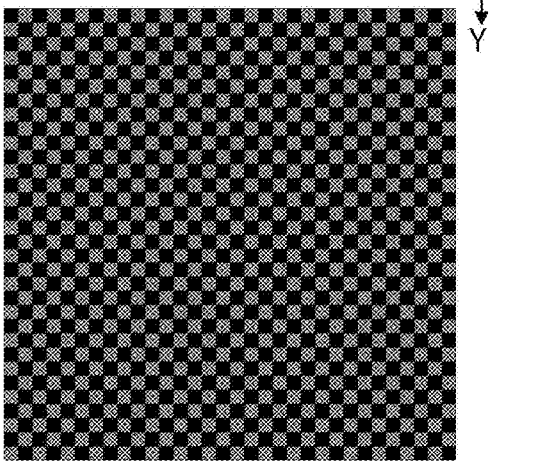

With regard to the pattern arranged in the same scanning direction such as, for example, the pattern arranged in the forward scanning direction, the houndstooth check pattern of the houndstooth checks having the lengths of 3×3×2 in the Y direction and the length of 1 in the X direction (FIG. 7E and FIG. 7F) is used according to the exemplary embodiment, but the present invention is not limited to this. As another example, FIGS. 21A to 21F and FIGS. 22A to 22F illustrate the multi-value mask pattern arranged in the forward scanning direction. FIG. 21A and FIG. 22A illustrate the multi-value mask used in the first scanning, FIG. 21B and FIG. 22B illustrate the multi-value mask used in the second scanning, FIG. 21C and FIG. 22C illustrate the multi-value mask used in the third scanning, and FIG. 21D and FIG. 22D illustrate the multi-value mask used in the fourth scanning. The white part indicates the mask value "0", the hatched part indicates the mask value "1", and the black part indicates the mask value "2". FIG. 21E and FIG. 22E illustrate the arrangement where the recording is performed by the forward scanning based on the first scanning+the third scanning. FIG. 21F and FIG. 22F illustrate the arrangement where the recording is performed by the backward scanning based on the second scanning+the fourth scanning. As the arrangement where the recording is performed in the forward direction or the backward direction, a houndstooth check pattern having a size of a length of 4 in the Y direction×a length of 1 in the X direction as illustrated in FIG. 21E and FIG. 21F may be used. In addition, a houndstooth check pattern having a size of a length of 1 in the Y direction×a length of 1 in the X direction as illustrated in FIG. 22E and FIG. 22F may be used. That is, any pattern in which the dots are dispersed to be arranged when the pattern is combined with the time division driving order may be used. A repetition pattern size smaller than the number of blocks in the time division driving is preferably used. As compared with a case where the repetition pattern size is larger than the number of blocks in the time division driving, the dot arrangement is not changed for each section, and there is little fear that the dot arrangement is visually recognized as a texture. In addition, since the houndstooth check pattern as described above is the dot arrangement having a relatively satisfactory dispersibility even in a state in which the displacement between the forward and backward scannings does not occur, a pattern having a large number of high-frequency components and a high intensity in a case where the pattern is subjected to a frequency analysis is preferably used as the multi-value mask pattern arranged in the forward scanning direction.

Figure 23A:
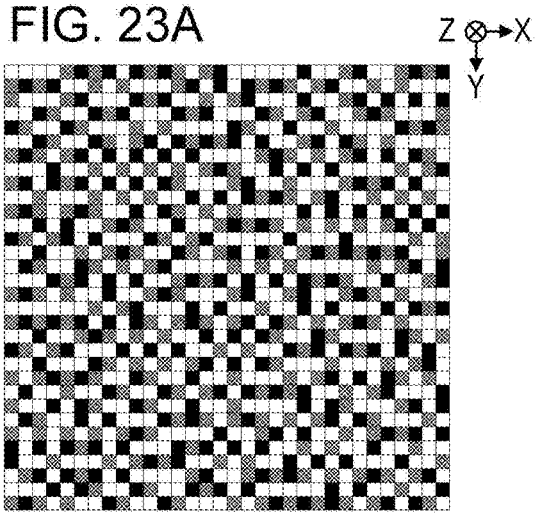
FIGS. 23A to 23F are schematic diagrams of the multi-value mask pattern according to the exemplary embodiment.
Figure 23B:
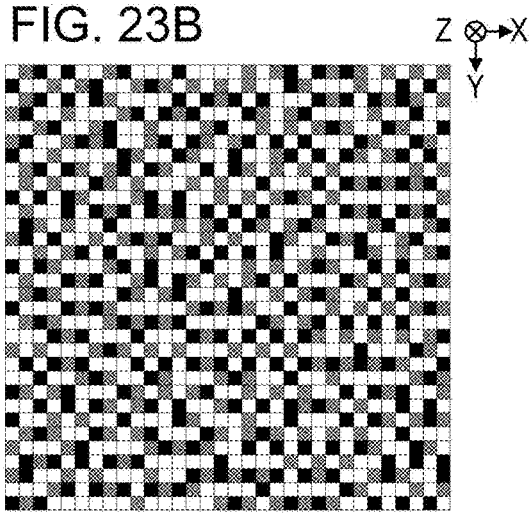
Figure 23C:
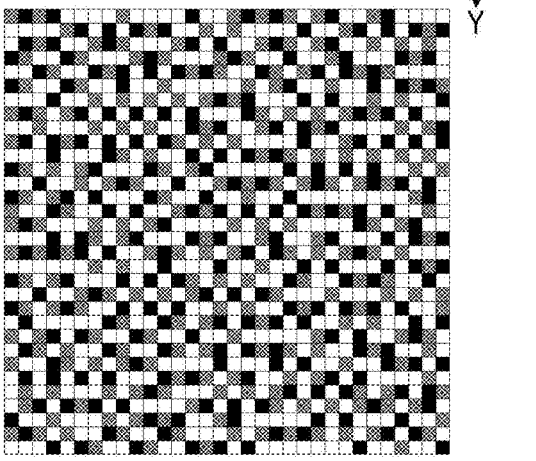
Figure 23D:
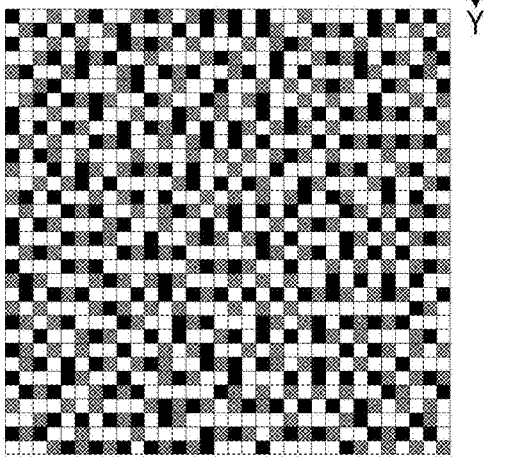
Figure 23E:
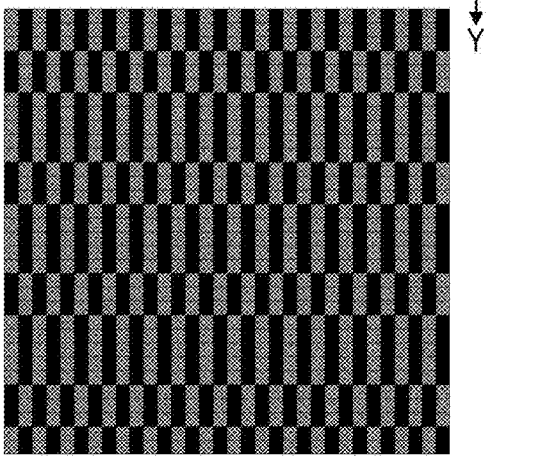
Figure 23F:
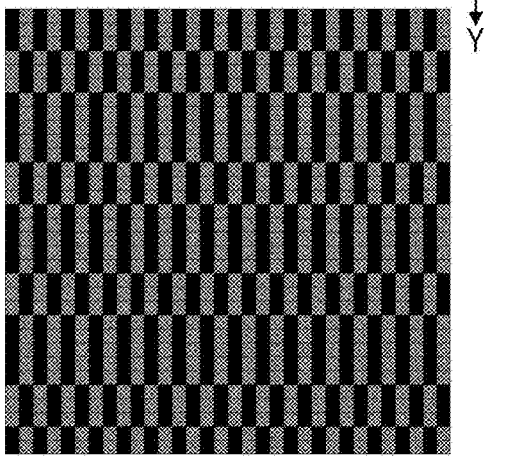

The multi-value mask pattern used in the first exemplary embodiment (MP1 to MP4), the pattern arranged in the forward scanning (MP1+MP3), and the pattern arranged in the backward scanning (MP2+MP4) are the vertically long houndstooth check pattern, and the high-frequency components are dominant. The pattern itself for each scanning (MP1, MP2, MP3, MP4) has a white noise characteristic in which a spatial frequency is not particularly high. In a case where the above-described multi-value mask pattern is used, when an irregular displacement (for example, a conveyance displacement) occurs in only one scanning, a blank area in accordance with this pattern appears, and there is a risk that this blank area may be visually recognized as a non-uniformity. To make it difficult to visually recognize the blank area appearing at this time, the pattern for each scanning also preferably has the characteristic of the high spatial frequency. FIGS. 23A to 23F illustrate examples thereof. FIG. 23A illustrates the multi-value mask used in the first scanning, FIG. 23B illustrates the multi-value mask used in the second scanning, FIG. 23C illustrates the multi-value mask used in the third scanning, and FIG. 23D illustrates the multi-value mask used in the fourth scanning. The white part indicates the mask value "0", the hatched part indicates the mask value "1", and the black part indicates the mask value "2". FIG. 23E illustrates an arrangement in which the recording is performed by the forward scanning based on the first scanning+the third scanning, and FIG. 23F illustrates an arrangement in which the recording is performed by the backward scanning based on the second scanning+the fourth scanning. The pattern arranged in the forward scanning (FIG. 23E) and the pattern arranged in the backward scanning (FIG. 23F) are the same as FIG. 7E and FIG. 7F. On the other hand, the pattern for each scanning (FIG. 23A, FIG. 23B, FIG. 23C, and FIG. 23D) has suppressed low-frequency components and more high-frequency components as compared with the pattern of FIGS. 13A to 13F. These four patterns are a pattern in which an intermediate image based on the dots formed by the respective scannings have a blue noise characteristic.

These patterns can be obtained in a manner that recording permit pixels of the mask patterns are determined while paying attention to indices related to the dispersity of the dots in a designing stage of the mask patterns, and the level of the characteristic related to the spatial frequency is set to be close to a desired level.

According to the present exemplary embodiment, the case has been described where the recording of the predetermined image formation area is completed by the four scannings. To increase the speed of the recording as compared with the above-described case, in a case where the recording is completed by two scannings, the multi-value mask pattern (MP1+MP3) of FIG. 7E is used in the first scanning, and the multi-value mask pattern (MP2+MP4) of FIG. 7F is used in the second scanning. With this configuration, the same effect as the exemplary embodiment with respect to the displacement between the forward and backward scannings can be attained. On the contrary, with a purpose of forming a beautiful image even in a slow recording process, in a case where the recording is completed by eight scannings to increase the multi-pass effect, the following configuration is adopted. First, the multi-value mask pattern (MP1+MP3) of FIG. 7E is decomposed into four multi-value mask patterns (MP1+MP3_1, MP1+MP3_2, MP1+MP3_3, and MP1+MP3_1_4). Then, the multi-value mask pattern (MP2+MP4) of FIG. 7F is also decomposed into four multi-value mask patterns (MP2+MP4_1, MP2+MP4_2, MP2+MP4_3, and MP2+MP4_4). When those patterns are alternately used (MP1+MP3_1, MP2+MP4_1, MP1+MP3_2, MP2+MP4_2, . . . ), it is possible to attain the same effect as the exemplary embodiment with respect to the displacement between the forward and backward scannings while the multi-pass effect is increased.

Next, adjustment of the recording position according to the present exemplary embodiment will be described. Hereinafter the adjustment of the recording position will be also referred to as a registration adjustment.

First, in a case where an instruction of executing the registration adjustment is input from the user through the host PC E5000 or the front panel E0106 illustrated in FIG. 29, the recording apparatus executes a second mode for adjusting the recording position (registration adjustment) to the recording medium by the recording head. This mode is separately prepared in addition to a first mode for recording an actual image in which the recording of the image specified by the user is performed. This mode is a mode of recording a test pattern (registration adjustment pattern) for the registration adjustment, and the recording of the actual image can be performed after the user performs the registration adjustment.

Figure 27A:
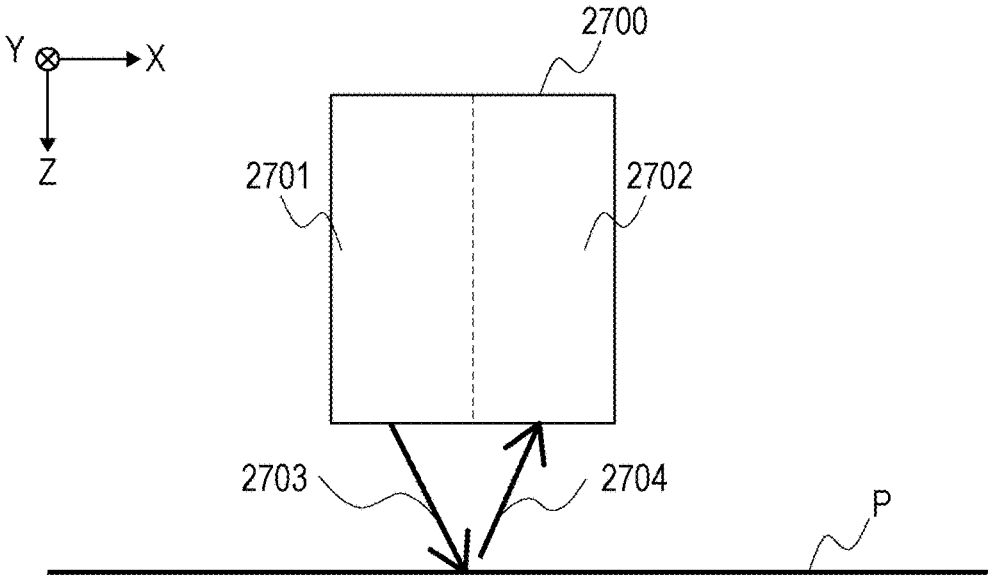
FIGS. 27A and 27B are schematic diagrams for describing a registration adjustment method according to the exemplary embodiment.
Figure 27B:
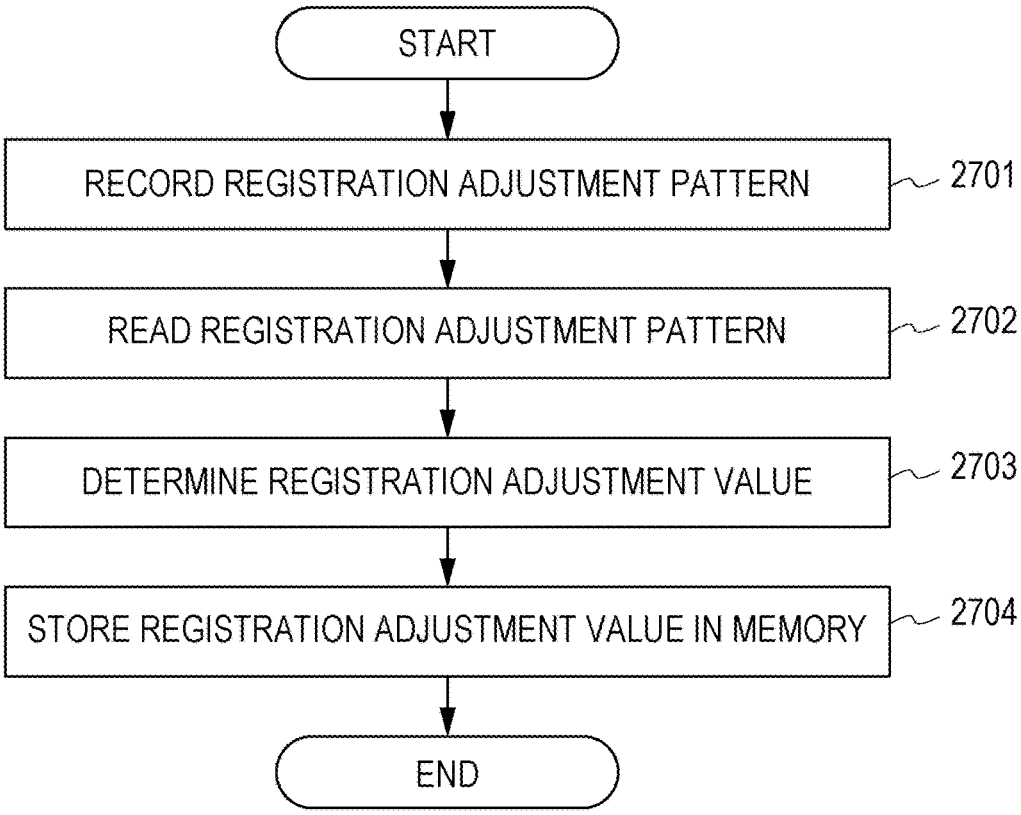

FIG. 27B is a flow chart of the registration adjustment executed by the recording apparatus. When the execution instruction of the registration adjustment from the user is input to the main substrate E0014, the ASIC E1102 causes the recording head 102 to record the registration adjustment pattern (FIG. 27B: 2701).

FIGS. 25A and 25B illustrate examples of the registration adjustment pattern. FIG. 25A illustrates a reference pattern 25*a* for a registration adjustment pattern. In the reference pattern 25*a*, rectangular patterns having 16 dots in the X direction at 1200 dpi and 96 dots in the Y direction at 600 dpi are arranged in the X direction at a predetermined interval. The interval between the mutual rectangular patterns is equivalent to 16 dots at 2400 dpi. FIG. 25B illustrates an adjustment pattern 25*b* recorded while reflecting the registration adjustment value. The one reference pattern is recorded by the same nozzle column. In addition, the one adjustment pattern is recorded by the same nozzle column. Descriptions related to these configurations will be given below. Data of the patterns stored in the ROM E1004 is used.

Figure 26A:
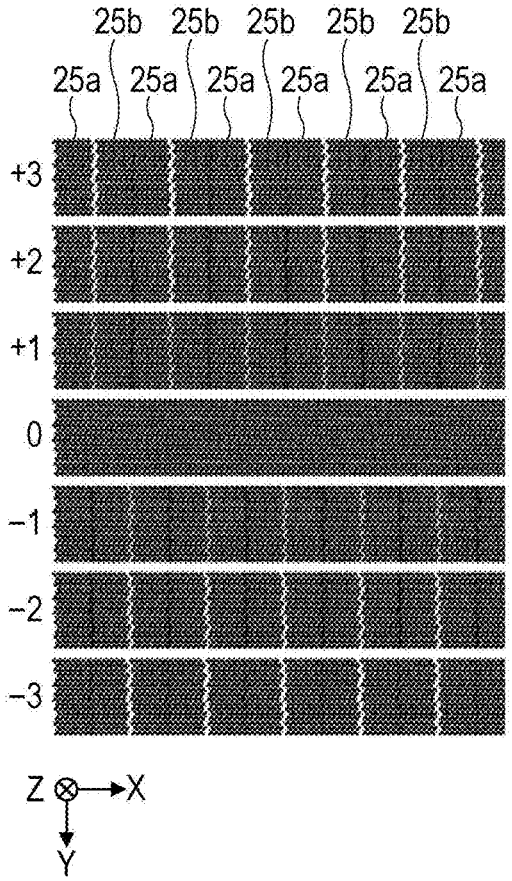
FIGS. 26A to 26D are schematic diagrams for describing two registration adjustment patterns having different driving orders.

The recording positions of the reference pattern and the adjustment pattern are displaced by a predetermined amount, and the registration adjustment patterns are printed on the recording medium as illustrated in FIG. 26A. The plurality of registration adjustment patterns are formed by shifting the registration adjustment values in units of 1200 dpi (approximately 21.2 μm) from +3 to −3 by the decrement of 1, and numbers on the left side of the registration adjustment patterns are the registration adjustment values. To realize the above-described configuration, the formation is made by controlling the ink ejection timings on the basis of the registration adjustment values. The control on the shifting amount is performed by controlling the driving timing of the recording element for ejecting the ink in accordance with the movement based on the scanning of the carriage by the head control signal E1021 while the ASIC E1102 detects the signal from the encoder sensor E0004.

This registration adjustment pattern is formed by shifting the ink landing position for recording the adjustment pattern while the ejection timing is advanced or delayed with respect to the reference pattern. The shifting amount of this driving timing corresponds to the registration adjustment value. Numbers −3 to +3 indicated on the side of the registration adjustment patterns of FIG. 26A are the registration adjustment values. A side on which the driving timing of the adjustment pattern is advanced with respect to the reference pattern is set as "+", and the driving timing of the adjustment pattern is delayed with respect to the reference pattern is set as "−". By observing the recorded registration adjustment patterns, the user selects a registration adjustment value of the most uniform registration adjustment pattern among the registration adjustment patterns (in the present example, a registration adjustment value of 0 without vertical streaks). Then, the registration adjustment value is input from a screen or the like of a driver (not illustrated) through the host PC E5000 or the front panel E0106 from the user. The ASIC E1102 determines that the accepted input registration adjustment value is used in the actual image recording mode (2703) and stores this value in the EEPROM E1005 (FIG. 27B: 2704). In the actual image recording mode, the driving timing of the recording element for the ink ejection in accordance with the movement based on the carriage scanning is controlled by the head control signal E1021 on the basis of this registration adjustment value. With regard to the registration adjustment patterns corresponding to the respective registration adjustment values, the distance in the X direction between the reference pattern 25*a* and the adjustment pattern 25*b* is not changed in accordance with the position in the Y direction. A relationship between the array of the dots in the Y direction forming the same column and the relative position in the X direction between the dots is the same in the reference pattern 25*a* and the adjustment pattern 25*b*. The relationship with regard to the dot arrangements between the reference pattern 25*a* and the adjustment pattern 25*b* herein is the same as the relationship between the dot arrangement in the forward direction recording and the dot arrangement in the backward direction recording described with reference to FIGS. 19A to 19C. To realize such a dot arrangement, the recording apparatus performs the control on the recording similarly as in the control on the time division driving at the time of the above-described image recording.

While the reference pattern and the adjustment pattern are allocated to the desired nozzle columns, it is possible to perform the individual registration adjustment. As an example, FIG. 25C illustrates a type and a reference of a registration adjustment item, adjustment, and allocation of the nozzles for recording the respective patterns. For example, the plurality of reference patterns 25*a* are recoded in the forward direction by the column of the nozzles 202 for ejecting the ink amount of 5 pl in the C column in FIG. 2C. Subsequently, when the plurality of adjustment pattern 25*b* having different shifting amounts with respect to the reference in the backward direction by the same nozzle column, it is possible to form the registration adjustment pattern between the forward scanning and the backward scanning with regard to the nozzle column for 5 pl in the C column. The registration adjustment between the forward scanning and the backward scanning can be performed on the basis of this pattern. The same may also apply to the nozzle column for 2 pl of FIG. 2C.

When the reference pattern 25*a* is recorded by the forward direction scanning using the column of the nozzles 202 for ejecting the ink amount of 5 pl in the C column of FIG. 2C, and the adjustment pattern 25*b* is recorded by the forward direction scanning using the column of the nozzles 203 for ejecting the ink amount of 2 pl in the C column, the registration adjustment between the nozzles for 5 pl and 2 pl in the C column can be performed. When the reference pattern 25*a* is recorded by the scanning in the even column of the K column described with reference to FIG. 2B and the adjustment pattern 25*b* is recorded by the scanning in the odd column of the K column in the same direction, the registration adjustment between the even column and the odd column of the K column can be performed. Furthermore, while a situation where the nozzle column is inclined with respect to the conveyance direction of the recording medium due to an error to some extent and attached is taken into account, it is possible to perform θ registration adjustment. For example, the reference pattern 25*a* is recorded by several nozzles at the end on the sheet supply side in the odd column of the K column in FIG. 2B (upstream side in the Y direction), and after a predetermined conveyance is performed, the adjustment pattern 25*b* is recorded by several nozzles at the end on the sheet discharging side in the odd column of the K column (downstream side in Y direction). With this configuration, it is possible to form the registration adjustment pattern for the θ registration adjustment. When the registration adjustment value is determined by using this registration adjustment pattern, it is possible to adjust the recording position displacement caused by an inclination of the nozzle column.

Figure 26B:
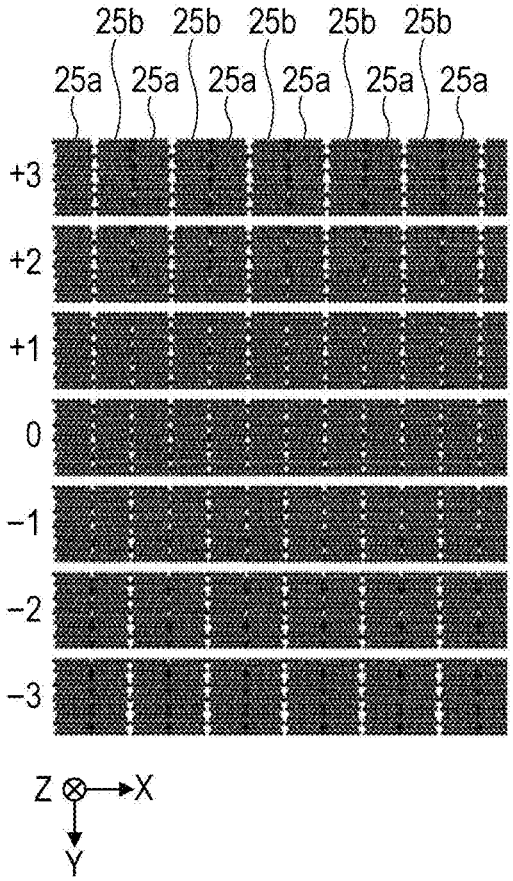

Herein, FIG. 26B illustrates the registration adjustment patterns corresponding to the respective registration adjustment values in a case where the respective registration adjustment patterns are recorded without changing the driving orders of the respective nozzles in the forward scanning and the backward scanning with regard to the registration adjustment between the forward scanning and the backward scanning. In this registration adjustment pattern, the relative relationship of the ink landing position in the X direction with respect to the array of the nozzle columns is inverted in the reference pattern and the adjustment pattern. Accordingly, the change in the density of the recorded pattern with respect to the slight recording position displacement between the forward scanning and the backward scanning is suppressed because of the above-described effect, as may be understood from the drawing, it is difficult to discriminate the registration adjustment patterns having different adjustment values.

In this case, a slight white streak exists even in the registration adjustment pattern having the correctly matched relative recording position between the forward scanning and the backward scanning (in this case, the registration adjustment value "0"). Thus, it is difficult to discriminate which one of the registration +1, 0, and −1 is satisfactory, and the user may be hesitated to select the correct registration adjustment value. In a case where the correct registration adjustment value is not determined, there is a fear that granularity of the image is deteriorated, or a line is unexpectedly thickened in a case where a ruled line is recorded, for example.

Figure 26C:
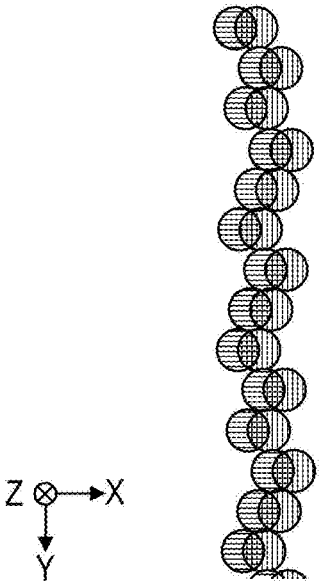
Figure 26D:
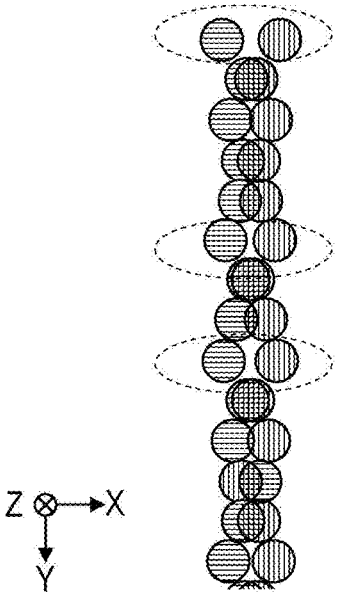

Herein, FIG. 26C schematically illustrates an adjoining border between the reference pattern 25*a* (horizontal line) and the adjustment pattern 25*b* (vertical line) of the registration adjustment pattern having the adjustment value of 0 in FIG. 26A. In this case, the dot arrangement in the X direction in accordance with the position in the Y direction is completely the same in the reference pattern 25*a* and the adjustment pattern 25*b*. Thus, in a case where the recording position is matched (registration is matched), no gap exists in the part, and the distance between the adjacent dots in the X direction is uniform in the Y direction. FIG. 26D schematically illustrates an adjoining border between the reference pattern 25*a* (horizontal line) and the adjustment pattern 25*b* (vertical line) of the registration adjustment pattern having the adjustment value of 0. In this case, since dot-dense portions and dot-sparse portions of the mutual adjacent dots are generated in the Y direction, locations where the white background of the recording medium can be seen periodically appear as represented by parts surrounded by dotted lines of FIG. 26D. Accordingly, it is difficult to perform distinction from the dot-dense portions and dot-sparse portions generated by changing the registration adjustment value and discriminate the optimal pattern.

In view of the above, the registration adjustment pattern described in FIG. 26A is adopted according to the present exemplary embodiment. For example, regarding the forward scanning and the backward scanning, in the case of the mode in which the registration adjustment is performed, the driving of the recording element is performed such that, with regard to the same nozzle column, the driving order with respect to the array of the nozzles in the group is inverted in the forward scanning and the backward scanning. On the other hand, in the case of the actual image recording mode, the driving of the recording element is performed such that, with regard to the same nozzle column, the driving order with respect to the array of the nozzles in the group in the backward direction scanning is not inverted to the driving order with respect to the array of the nozzles in the group in the forward direction scanning.

With this configuration, while the fluctuation in the density of the image which is caused by the displacement of the recording positions between the forward and backward scannings is suppressed in the recording of the actual image, it is possible to perform the more accurate adjustment in the adjustment processing of the recording positions between the forward and backward scannings.

In addition, according to the above-described exemplary embodiment, the method for the user to visually check the pattern to select the adjustment value and input the adjustment value to the recording apparatus has been described as an example, but a mode in which the recording apparatus includes an optical sensor 2700 illustrated in FIG. 27A may be adopted such that the recording position adjustment processing can be automatically performed. The optical sensor 2700 can use the color development appropriately selected in accordance with an ink color tone used in the recording apparatus, the head configuration, or the like.

For example, a registration adjustment pattern may be created by using ink of a color having an excellent light absorption characteristic with respect to color development of a red LED or an infrared LED, and the red LED mounted to the optical sensor 2700 may read this the optical sensor 2700. In terms of the absorption characteristic, black (Bk) or cyan (C) is preferably used, and magenta (M) or yellow (Y) does not obtain a sufficient density characteristic or signal to noise (S/N) ratio. In this manner, while the used color is determined in accordance with the characteristic of the used LED, it is possible to manage the respective colors. For example, while a blue LED, a green LED, and the like are mounted to the optical sensor 2700 in addition to the red LED, it is possible to perform dot alignment processing with respect to Bk for each of the colors (C, M, and Y).

FIG. 27A is a schematic diagram for describing the optical sensor 2700 used in the apparatus of FIGS. 1A and 1B. FIG. 27B illustrates a flow for the recording apparatus to perform the registration adjustment using the optical sensor 2700. The optical sensor 2700 is attached to the carriage 106 described above which is not illustrated in FIG. 27A and includes a light emitting unit 2701 and a light receiving unit 2702 as illustrated in FIGS. 25A to 25C.

The recording of the registration adjustment pattern in 2701 has been described above, and the descriptions thereof will be omitted. Light $I_{in}$ 2703 emitted from the light emitting unit 2701 is reflected by the recording medium P, and reflected light $I_{REF}$ 2704 can be detected by the light receiving unit 2702. In this manner, the optical sensor 2700 reads a plurality of formed registration adjustment patterns (FIG. 27B: 2702). Subsequently, the detection signal is transmitted to the main substrate side of the recording apparatus via the CRFFC E0012 and converted into a digital signal by an analog-to-digital (A/D) converter (not illustrated). The ASIC that has received the converted signal determines an appropriate registration adjustment value on the basis of the signal of each of the registration adjustment patterns corresponding to different registration adjustment values (FIG. 27B: 2703) and stores the registration adjustment value in the EEPROM E1005 (FIG. 27B: 2704).

In addition, the recording apparatus according to the exemplary embodiment may be an inkjet recording apparatus including a scanner such as a multi-function printer (MFP). In this recording apparatus, after the registration adjustment pattern is printed on the recording medium, the user may set the printed registration adjustment pattern in a scanner. Then, the scanner may read the registration adjustment pattern to perform the above-described steps 2702 and 2703 in FIG. 27B and determine the adjustment value.

In addition, according to the above-described exemplary embodiment, the heaters that generate thermal energy for ejecting the ink are used as the recording elements as an example, but piezoelectric elements that perform mechanical displacement on the basis of driving signals may be used as the recording elements.

In addition to the colored ink exemplified according to the above-described exemplary embodiment, transparent clear ink that overcoats the colored ink on the recording medium or reactive ink that reacts with the colored ink and increases a fixing property of the colored ink onto the recording medium can be also used as the "ink".

According to the exemplary embodiment of the present invention, while the fluctuation in the density of the image which is caused by the displacement of the recording positions between the forward and backward scannings is suppressed in the image recording, it is possible to perform the more accurate adjustment in the adjustment processing of the recording positions between the forward and backward scannings.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-157714, filed Aug. 7, 2015, which is hereby incorporated by reference herein in its entirety.

What is claimed is:

1. A recording apparatus comprising:

a recording head including a plurality of recording elements configured to eject ink which are arranged in a predetermined direction, the recording elements being arranged into a plurality of groups each of which is constituted by a plurality of predetermined adjacent recording elements;

a scanning unit configured to execute a recording scanning in a forward direction and a recording scanning in a backward direction along an intersecting direction that intersects with the predetermined direction with respect to a unit area including a pixel area equivalent to a plurality of pixels on a recording medium by the recording head;

a driving unit configured to drive each of the plurality of predetermined adjacent recording elements in order at different timings in the recording scanning in the forward direction and the recording scanning in the backward direction; and a determination unit configured to determine a first mode in which an image specified by a user is recorded by the recording scanning in the forward direction and the recording scanning in the backward direction by the scanning unit or a second mode in which a pattern is recorded in each of the recording scanning in the forward direction and the recording scanning in the backward direction by the scanning unit so as to form an adjustment pattern for adjusting a recording position in the intersecting direction of the recording head, wherein a relative position of a recording position by the recording scanning in the forward direction and a recording position by the recording scanning in the backward direction in the first mode is adjusted in accordance with information relating to the formed adjustment pattern, wherein the driving unit is arranged to drive the plurality of predetermined adjacent recording elements in a manner that, in a case where the determination unit determines the first mode, the plurality of predetermined adjacent recording elements are driven in a first order in the recording scanning in the forward direction and the plurality of predetermined adjacent recording elements are driven in an order that is different from an inverted order of the first order in the recording scanning in the backward direction, and in a case where the determination unit determines the second mode, the plurality of predetermined adjacent recording elements are driven in a second order in the recording scanning in the forward direction and the plurality of predetermined adjacent recording elements are driven in an inverted order of the second order in the recording scanning in the backward direction.

2. The recording apparatus according to claim 1, wherein in the second mode the driving unit is operated such that a plurality of the adjustment patterns are formed in which among the plurality of the adjustment patterns, relative positions of the pattern recorded by the recording scanning in the forward direction and the pattern recorded by the recording scanning in the backward direction in the intersecting direction are mutually different.

3. The recording apparatus according to claim 1, further comprising a generation unit configured to generate recording data used for the recording scannings in a manner that, in the first mode and in a case where maximum one recording is permitted in each pixel area in the unit area, a number of pixels adjacent in the intersecting direction to the pixel area of the unit area where the recording is permitted in the recording scanning in the backward direction in the pixel area of the unit area where the recording is permitted in the recording scanning in the forward direction is higher than a number of pixels adjacent in the intersecting direction to the pixel area of the unit area where the recording is permitted in the recording scanning in the backward direction.

4. The recording apparatus according to claim 1, the driving unit is arranged to drive the plurality of predetermined adjacent recording elements in a manner that, in a case where the determination unit determines the first mode, the plurality of predetermined adjacent recording elements are driven in the first order in the recording scanning in the forward direction and the plurality of predetermined adjacent recording elements are driven in an order that is different from an inverted order of the first order and an order having offset relationship for the inverted order of the first order in the recording scanning in the backward direction.

5. The recording apparatus according to claim 1, further comprising a sensor configured to read the formed adjustment pattern, and the information relating to the formed adjustment pattern is based on the reading result by the sensor.

6. The recording apparatus according to claim 1, the information relating to the formed adjustment pattern is based on input by user.

7. A recording method comprising:

executing, by using a recording head including a plurality of recording elements configured to eject ink which are arranged in a predetermined direction, a recording scanning in a forward direction and a recording scanning in a backward direction along an intersecting direction that intersects with the predetermined direction with respect to a unit area including a pixel area equivalent to a plurality of pixels on a recording medium; and driving, with regard to each of a plurality of groups constituted by a plurality of predetermined adjacent recording elements among the plurality of recording elements of the recording head used for the recording of the unit area, each of the plurality of predetermined adjacent recording elements in order at different timings in the recording scanning in the forward direction and the recording scanning in the backward direction, wherein the plurality of predetermined adjacent recording elements are driven in a manner that, in a case where an image specified by a user is recorded by the recording scanning in the forward direction and the recording scanning in the backward direction, the plurality of predetermined adjacent recording elements are driven in an first order in the recording scanning in the forward direction and the plurality of predetermined adjacent recording elements are driven in an order that is different from an inverted order of the first order in the recording scanning in the backward direction, and in a case where a pattern is recorded in each of the recording scanning in the forward direction and the recording scanning in the backward direction to form an adjustment pattern for adjusting a recording position in the intersecting direction of the recording head, wherein a relative position of a recording position by recording scanning in the forward direction and a recording position by the recording scanning in the backward direction in the first mode is adjusted in accordance with information relating to the formed adjustment pattern, the plurality of predetermined adjacent recording elements are driven in a second order in the recording scanning in the forward direction and the plurality of predetermined adjacent recording elements are driven in an inverted order of the second order in the recording scanning in the backward direction.

8. The recording method according to claim 7, wherein among the plurality of the adjustment patterns, relative positions of the pattern recorded by the recording scanning in the forward direction and the pattern recorded by the recording scanning in the backward direction in the intersecting direction are mutually different.

9. The recording method according to claim 7, further comprising generating recording data used for the recording scannings for recording an image specified by a user in a manner that, in a case where maximum one recording is permitted in each pixel area in the unit area, a number of pixels adjacent in the intersecting direction to the pixel area of the unit area where the recording is permitted in the recording scanning in the backward direction in the pixel area of the unit area where the recording is permitted in the recording scanning in the forward direction is higher than a number of pixels adjacent in the intersecting direction to the pixel area of the unit area where the recording is permitted in the recording scanning in the backward direction.

10. The recording method according to claim 7, an image specified by a user is recorded by the recording scanning in the forward direction and the recording scanning in the backward direction, the plurality of predetermined adjacent recording elements are driven in the first order in the recording scanning in the forward direction and the plurality of predetermined adjacent recording elements are driven in an order that is different from an inverted order of the first order and an order having offset relationship for the inverted order of the first order in the recording scanning in the backward direction.

11. The recording method according to claim 7, wherein the information relating to the formed adjustment pattern is based on the reading result by a sensor configured to read the formed adjustment pattern.

12. The recording method according to claim 7, the information relating to the formed adjustment pattern is based on input by user.

* * * * *